US007913557B2

(12) United States Patent
Vasques et al.

(10) Patent No.: US 7,913,557 B2
(45) Date of Patent: Mar. 29, 2011

(54) ADJUSTABLE TESTING TOOL AND METHOD OF USE

(75) Inventors: Ricardo Vasques, Sugar Land, TX (US); Gustavo Andreolli Ribeiro, Tupa-SP (BR); Cosan Ayan, Istanbul (TR); Nicolas Adur, Santiago del Estero (AR); Arne Richard Pedersen, Tolvsrod (NO); Antonio Castilho, Macae-RJ (BR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/577,847

(22) Filed: Oct. 13, 2009

(65) Prior Publication Data

US 2010/0024540 A1 Feb. 4, 2010

Related U.S. Application Data

(62) Division of application No. 11/693,147, filed on Mar. 29, 2007, now abandoned.

(60) Provisional application No. 60/845,332, filed on Sep. 18, 2006.

(51) Int. Cl.
*E21B 47/08* (2006.01)

(52) U.S. Cl. ..... 73/152.55

(58) Field of Classification Search ..... 73/152.55
See application file for complete search history.

(56) References Cited

U.S. PATENT DOCUMENTS

| | | | | |
|---|---|---|---|---|
| 3,243,122 | A | 3/1966 | Snaper | |
| 3,456,504 | A | 7/1969 | Bombardieri | |
| 3,908,454 | A | 9/1975 | Mullins et al. | |
| 3,993,131 | A | 11/1976 | Riedel | |
| 4,353,249 | A | 10/1982 | Lagus et al. | |
| 4,366,862 | A | 1/1983 | Brandell | |
| 4,392,376 | A | 7/1983 | Lagus et al. | |
| 4,526,230 | A * | 7/1985 | Kojicic | 166/236 |
| 4,535,843 | A | 8/1985 | Jageler | |
| 4,860,581 | A | 8/1989 | Zimmerman et al. | |
| 4,884,439 | A * | 12/1989 | Baird | 73/152.24 |

(Continued)

FOREIGN PATENT DOCUMENTS

EP 0999344 6/2004

(Continued)

OTHER PUBLICATIONS

Poesio et al., Formation and Ultrasonic Removal of Fouling Particle Structures in a Natural Porous Material, Journal of Petroleum Science and Engineering, Dec. 2004, vol. 45, pp. 159-178.

*Primary Examiner* — Hezron Williams
*Assistant Examiner* — Alex Devito
(74) *Attorney, Agent, or Firm* — Dave R. Hofman

(57) ABSTRACT

Methods and systems for testing a subterranean formation penetrated by a wellbore are provided. A testing tool has a plurality of packers spaced apart along the axis of the tool, and at least a testing port. The testing tool is positioned into the wellbore and packers are extended into sealing engagement with the wellbore wall, sealing thereby an interval of the wellbore. In some embodiments, the wellbore interval sealed between two packers is adjusted downhole. In one embodiment, the location of the testing port is adjusted between two packers. The methods may be used to advantage for reducing the contamination of the formation fluid by fluids or debris in the wellbore.

7 Claims, 15 Drawing Sheets

U.S. PATENT DOCUMENTS

| | | | |
|---|---|---|---|
| 4,936,139 | A | 6/1990 | Zimmerman et al. |
| 5,246,862 | A | 9/1993 | Grey et al. |
| 5,411,082 | A | 5/1995 | Kennedy |
| 5,488,990 | A | 2/1996 | Wadleigh et al. |
| 5,635,636 | A | 6/1997 | Alexander |
| 5,715,890 | A | 2/1998 | Nolen |
| 5,829,520 | A | 11/1998 | Johnson |
| 6,065,544 | A | 5/2000 | Holbert |
| 6,301,959 | B1 | 10/2001 | Hrametz et al. |
| 6,478,096 | B1 | 11/2002 | Jones et al. |
| 6,766,854 | B2 | 7/2004 | Ciglenec et al. |
| 6,939,717 | B2 | 9/2005 | Jiang et al. |
| 7,062,958 | B2 | 6/2006 | Diakonov et al. |
| 7,100,689 | B2 | 9/2006 | Williams et al. |
| 7,114,566 | B2 | 10/2006 | Vinegar et al. |
| 7,402,424 | B2 | 7/2008 | Raghuraman et al. |
| 7,427,504 | B2 | 9/2008 | Torgersen et al. |
| 7,432,109 | B2 | 10/2008 | Raghuraman et al. |
| 2002/0153137 | A1 | 10/2002 | Ziauddin et al. |
| 2003/0134426 | A1 | 7/2003 | Jiang et al. |
| 2004/0026125 | A1 | 2/2004 | Meister et al. |
| 2004/0104341 | A1 | 6/2004 | Betancourt et al. |
| 2004/0129874 | A1 | 7/2004 | Torgersen et al. |
| 2004/0219064 | A1 | 11/2004 | Raghuraman et al. |
| 2004/0231841 | A1 | 11/2004 | Niemeyer et al. |
| 2005/0155760 | A1 | 7/2005 | Hill et al. |
| 2006/0060351 | A1 | 3/2006 | Heathman et al. |
| 2006/0162935 | A1 | 7/2006 | MacDougall |
| 2006/0248949 | A1 | 11/2006 | Gregory et al. |
| 2007/0044960 | A1* | 3/2007 | Lovell et al. ..... 166/250.07 |
| 2008/0066904 | A1 | 3/2008 | Van Hal et al. |

FOREIGN PATENT DOCUMENTS

| | | |
|---|---|---|
| EP | 1710393 | 10/2006 |
| GB | 1256537 | 12/1971 |
| GB | 2390105 | 12/2003 |
| GB | 2412171 | 9/2005 |
| GB | 2434862 | 8/2007 |
| WO | WO98/42948 | 10/1998 |
| WO | WO0111189 | 2/2001 |
| WO | WO0229205 | 4/2002 |
| WO | WO2007027617 | 3/2007 |

* cited by examiner

ADJUSTABLE TESTING TOOL AND METHOD OF USE

CROSS-REFERENCE TO RELATED APPLICATIONS

The present application a divisional of U.S. patent application Ser. No. 11/693,147 filed Mar. 29, 2007. U.S. patent application Ser. No. 11/693,147 is a non-provisional application of provisional application No. 60/845,332 filed on Sep. 18, 2006, and relates to U.S. patent application Ser. No. 11/562,908 filed Nov. 22, 2006; U.S. Patent Application No. 60/882,701 filed Dec. 29, 2006; and U.S. Patent Application No. 60/882,359 filed Dec. 28, 2006, the disclosures of which are hereby incorporated herein by reference for all purposes.

TECHNICAL FIELD

The present invention relates to well testing tools and method of use. More particularly, the invention relates to testing tools having a plurality of packer elements and at least a testing port on the tool body.

BACKGROUND OF THE INVENTION

Advanced formation testing tools have been used for example to capture fluid samples from subsurface earth formations. The fluid samples could be gas, liquid hydrocarbons or formation water. Formation testing tools are typically equipped with a device, such as a straddle or dual packer. Straddle or dual packers comprise two inflatable sleeves around the formation testing tool, which makes contact with the earth formation in drilled wells when inflated and seal an interval of the wellbore. The testing tool usually comprises a port and a flow line communicating with the sealed interval, in which fluid is flown between the packer interval and in the testing tool.

Examples of such tools are schematically depicted in FIGS. 1A to 1D. FIG. 1A shows an elevational view of a typical drill-string conveyed testing tool 10*a*. Testing tool 10*a* is conveyed by drill string 13*a* into wellbore 11 penetrating a subterranean formation 12. Drill string 13*a* has a central passageway that usually allows for mud circulation from the surface, then through downhole tool 10*a*, through the drilling bit 20 and back to the surface, as known in the art. Testing tool 10*a* may be integral to one of more drill collar(s) constituting the bottom hole assembly or "BHA". Testing tool 10*a* is conveyed among (or may itself) one or more measurement-while-drilling or logging while drilling tool(s) known to those skilled in the art. In some cases, the bottom hole assembly is adapted to convey a casing or a liner during drilling. Optionally, drill string 13*a* allows for two-way mud pulse telemetry between testing tool 10*a* and the surface. A mud pulse telemetry system typically comprises surface pressure sensors and actuators (such as variable rate pumps) and downhole pressure sensors and actuators (such as a siren) for sending acoustic signals between the downhole tool and the surface. These signals are usually encoded, for example compressed, and decoded by surface and downhole controllers. Alternatively any kind of telemetry known in the art may be used instead of mud pulse telemetry, such as electromagnetic telemetry or wired drill pipe telemetry. Tool 10*a* may be equipped with one or more packer(s) 26*a*, that are preferably deflated and maintained below the outer surface of tool 10*a* during drilling operations. When testing is desired, a command may be sent from the surface to the tool 10*a* via the telemetry system. Straddle packer 26*a* can be inflated and extended toward the wall of wellbore 11, achieving thereby a fluid connection between the formation 12 and the testing tool 10*a* across wellbore 11. As an example, tool 10*a* may be capable of drawing fluid from formation 12 into the testing tool 10*a*, as shown by arrows 30*a*. Usually one or more sensor(s) located in tool 10*a*, such as pressure sensor, monitors a characteristic of the fluid. The signal of such sensor may be stored in downhole memory, processed or compressed by a downhole processor and/or send uphole via telemetry. Note that in some cases, part of tool 10*a* may be retrievable if the bottom hole assembly becomes stuck in the wellbore, for example by lowering a wireline cable and a fishing head.

FIG. 1B shows an elevational view of a typical drill-stem conveyed testing tool 10*b*. Testing tool 10*b* is conveyed by tubing string 13*b* into wellbore 11 penetrating a subterranean formation 12. Tubing string 13*b* may have a central passageway that usually allows for fluid circulation (wellbore fluids or mud, treatment fluids, or formation fluids for example). The passageway may extend through downhole tool 10*b*, as known in the art. Tubing string 13*b* may also allow for tool rotation from the surface. Testing tool 10*b* may be integral to one of more tubular(s) screwed together. Testing tool 10*b* is conveyed among (or may be itself) one or more well testing tool(s) known to those skilled in the art, such as perforating gun. The testing tool 10*b* may be lowered in an open hole as shown, or in a cased wellbore. In some cases, tubing string 13*b* allows for two-way acoustic telemetry between testing tool 10*b* and the surface, or any kind of telemetry known in the art may be used instead. Tool 10*b* may be equipped with one or more packer(s) 26*b* that is usually retracted (deflated) during tripping of testing tool 10*b*. When testing is desired, tool 10*b* may be set into testing configuration, for example by manipulating flow in tubing string 13*b*. Extendable packer 26*b* can be extended (inflated) toward the wall of wellbore 11, achieving thereby a fluid connection between an interval of formation 12 and the testing tool 10*b* across wellbore 11. As an example, tool 10*b* may be capable of drawing fluid from formation 12 into the testing tool 10*b*, as shown by arrows 30*b*. Usually one or more sensor(s) located in tool 10*b*, such as pressure or flow rate sensor, monitor(s) a characteristic of the fluid. The signal of such sensor may be stored in downhole memory, processed or compressed by a downhole processor and/or send uphole via telemetry. Note that in some cases part of tool 10*b* may be a wireline run-in tool, lowered for example into the tubing string 13*b* when a test is desired.

FIG. 1C shows an elevational view of a typical wireline conveyed testing tool 10*c*. Testing tool 10*c* is conveyed by wireline cable 13*c* into wellbore 11 penetrating a subterranean formation 12. Testing tool 10*c* may be an integral tool or may be build in a modular fashion, as known to those skilled in the art. Testing tool 10*c* is conveyed among (or may itself) one or more logging tool(s) known to those skilled in the art. Preferably the wireline cable 13*c* allows signal and power communication between the surface and testing tool 10*c*. Testing tool 10*c* may be equipped with straddle packers 26*c*, that are preferably recessed below the outer surface of tool 10*c* during tripping operations. When testing is desired, straddle packer 26*c* can be extended (inflated) toward the wall of wellbore 11 achieving, thereby, a fluid connection between an interval of formation 12 and the testing tool 10*b* across wellbore 11. As an example, tool 10*c* may be capable of drawing fluid from formation 12 into the testing tool 10*c*, as shown by arrows 30*c*. Examples of such tools can be found U.S. Pat. No. 4,860,581 and U.S. Pat. No. 4,936,139, both assigned to the assignee of the present invention, and incorporated herein by reference. Note in some cases that wireline tools (and wireline cable) may be alternatively conveyed on a tubing string, or by a downhole tractor (not shown). Note also that the wireline tool may also be used in run-in tools inside a drill string, such as the drill string shown in FIG. 1*a*. In these cases, the wireline tool 10*c* usually sticks out of bit 20 and may perform measurements, for example when the bottom hole assembly is pulled out of wellbore 11.

FIG. 1D shows an elevational view of another typical wireline conveyed testing tool 10*d*. Testing tool 10*d* is conveyed by wireline cable 13*d* into wellbore 11 penetrating a subterranean formation 12. This time wellbore 11 is cased with a casing 40. Testing tool 10*d* may be equipped with one or more extendable (inflatable) packer(s) 26*d*, that are preferably recessed (deflated) below the outer surface of tool 10*d* during tripping operations. Tool 10*d* is capable of perforating the casing 40, usually below at least one packer (see perforation 41), for example, the tool could include one or more perforating gun(s). In FIG. 1D, the testing tool 10*d* is shown drawing fluid from formation 12 into the testing tool 10*d* (see arrows 30*d*). Usually one or more sensor(s) is located in tool 10*d*, such as a pressure sensor, monitors a characteristic of the fluid. The signal of such sensor is usually send uphole via telemetry. Note that in some cases, tools designed to test a formation behind a casing may also be used in open hole. Note also that cased formations may be evaluated by downhole tool conveyed by other means than wireline cables.

Typical tools are not restricted to two packers. Downhole systems having more than two packers have been disclosed for example in U.S. Pat. No. 4,353,249, U.S. Pat. No. 4,392,376, U.S. Pat. No. 6,301,959 or U.S. Pat. No. 6,065,544.

In some situations, a problem occurs when fluid is drawn into the tool through openings along the tool body. Formation fluids, wellbore fluids and other debris from the wellbore may occupy the volume between the upper sealed packer and the lower sealed packer. This causes various fluids to enter the same openings (or similar openings) located in the sealed volume. Moreover, when the density of the wellbore fluid is larger than the density of the formation fluid, it is very difficult to remove all of the wellbore fluid since there will be a residual of wellbore fluid that resides between the lowest opening and the lowest packer, even after a long pumping time. Thus, these wellbore fluids can contaminate the formation fluid entering the tool.

Downhole systems facilitating the adjustment of the flow pattern between the formation and the interior of the tool have been disclosed for example in patent application US 2005/0155760. These systems may be used to reduce the contamination of the formation fluid by mud filtrate surrounding the wellbore. Note that methods applicable for reducing the contamination by mud filtrate surrounding the wellbore are not always applicable for reducing the contamination by fluids and other debris from the wellbore.

Despite the advances in formation testing, there is a need for improved testing methods utilizing a tool having a plurality of packers spaced apart along the axis of the tool, and at least a port on the tool body located between two packer elements. Such methods are preferably capable of reducing the contamination of the formation fluid by fluid or debris in the wellbore. These methods may comprise adjusting in situ the length of a sealed interval between two packer elements. Alternatively, these methods may comprise adjusting the location of the port within a packer interval.

SUMMARY OF THE INVENTION

Methods and systems for testing a subterranean formation penetrated by a wellbore are provided. A testing tool has a tool body, a plurality of packer elements spaced apart from one another along the longitudinal axis of the tool body, and at least a testing port on the tool body located between two packer elements. The testing tool is positioned into the wellbore and packers are extended into sealing engagement with the wellbore wall, sealing thereby an interval of the wellbore. Fluid is flown between the sealed interval and the testing tool through the testing port.

In at least one aspect, the invention relates to a method that comprises the steps of selecting in situ the length of an interval of the wellbore to be sealed, and extending at least two packer elements. The length of the interval of the wellbore that is sealed by extending the packer elements is substantially equal to the selected length.

In another aspect, the invention relates to a method that comprises the step of extending at least two packer elements into sealing engagement with the wellbore wall, sealing thereby a first interval of the wellbore. The method also comprises the step of extending another packer element into sealing engagement with the wellbore wall, sealing thereby a second interval of the wellbore.

In yet another aspect, the invention relates to a method that comprises the step of adjusting a port on a testing tool.

In yet another aspect, the invention relates to a system for testing a subterranean formation penetrated by a wellbore. The system comprises a testing tool and a snorkel assembly adaptable on the testing tool. The snorkel assembly comprises a snorkel port and a fluid communication between the port on the tool body and the snorkel port, the snorkel port and the tool port being substantially offset from each other.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Certain examples are shown in the above identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Figure 2:
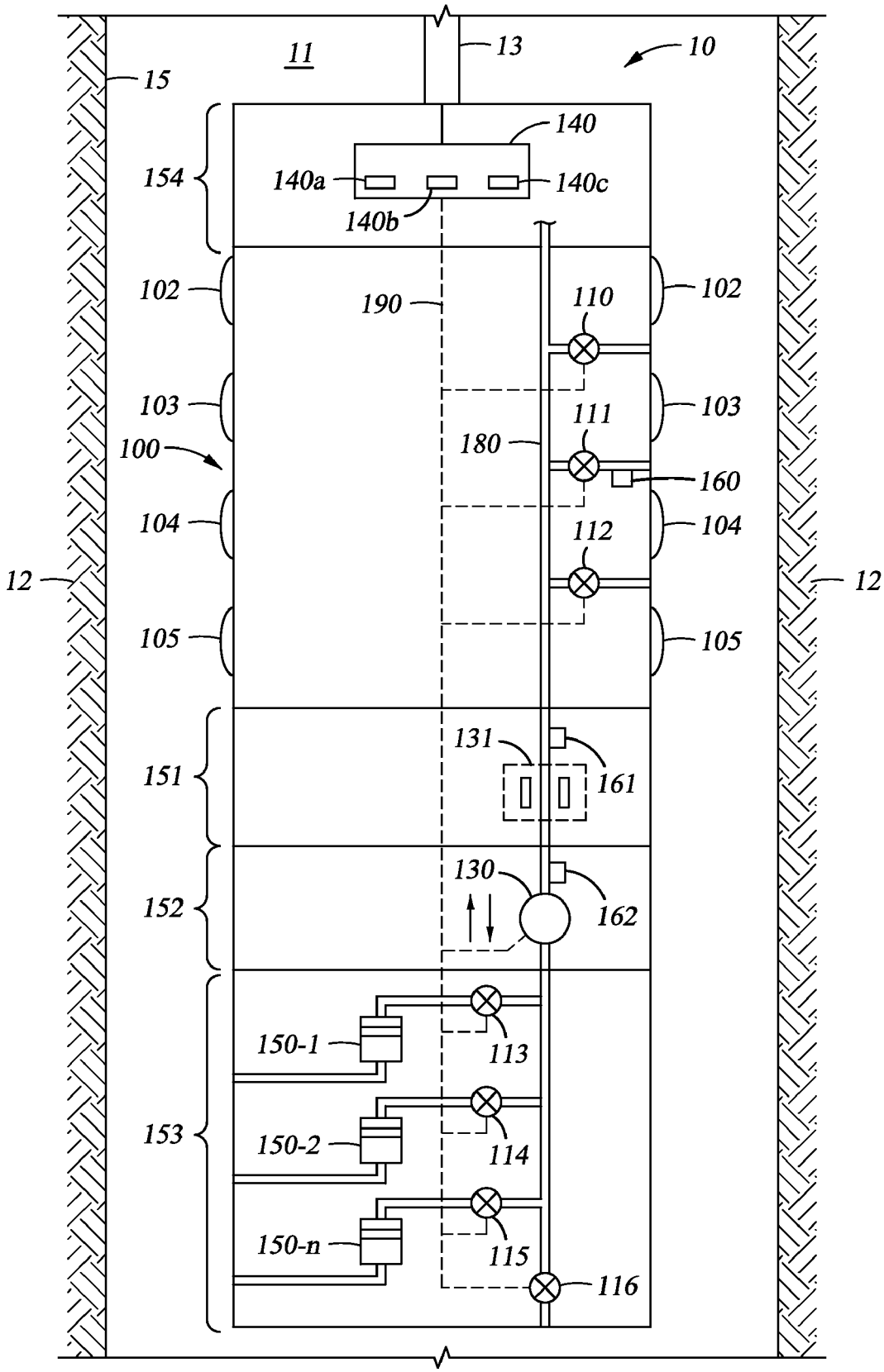
FIG. 2 is a schematic showing one embodiment of a testing tool capable of sealing wellbore intervals of various lengths.

FIG. 2 shows one embodiment of a testing tool capable of sealing wellbore intervals of various lengths. The testing tool 10 is conveyed within wellbore 11 created in formation 12 via conveyance mean 13. The testing tool 10 can be conveyed downhole using a wireline cable after the well has been drilled and the drill string removed from the wellbore. Alternatively, the testing tool can be conveyed downhole on the drill string used to drill the wellbore. Any conveyance mean known in the art can be used to convey the tool 10. Optionally, the conveyance mean allows for two ways communication between tool 10 and the surface, typically a surface monitor (not shown), via a telemetry system as known by those skilled in the art. When used with some conveyance means, tool 10 may accommodate for mud circulation through the tool (not shown), as well known by those skilled in the art. As shown in FIG. 2, the testing tool 10 is build in a modular fashion, with telemetry/electronics module 154, packer module 100, downhole fluid analysis module 151, pump module 152, and carrier module 153. Telemetry/electronics module 154 may comprise a controller 140, for controlling the tool operation, either from instructions programmed in the tool and executed by processor 140*a* and stored in memory 140*b*, or from instruction received from the surface and decoded by telemetry system 140*c*. Controller 140 is preferably connected to valves, such as valves 110, 111, 112, 113, 114, 115 and 116 via one or more bus 190 running through the modules of tool 10 for selectively enabling the valves. Controller 140 may also control a pump 130, collect data from sensors (such as optical analyzer 131), store data in memory 140*b* or send data to surface using telemetry system 140*c*. The fluid analysis module 151 may include an optical analyzer 131, but other sensors such as resistivity cells, pressure gauges, temperature gauges, may also be included in fluid analysis module 151 or in any other locations in tool 10. Pump module 152 may comprise the pump 130, which may be a bidirectional pump, or an equivalent device, that may be used to circulate fluid along the tool modules via one or more flow line 180. Carrier module 153 can have a plurality of cavities, such as cavities 150-1, 150-2, to 150-N to either store samples of fluid collected downhole, or transport materials from the surface, as required for the operation of tool 10. Packer elements 102, 103, 104 and 105 are shown uninflated and spaced along the longitudinal axis of packer module 100. Although not shown, the packers extend circumferentially around tool 100 so that when they are inflated they will each form a seal between the tool and a wellbore wall 15.

Also shown on FIG. 2 are particle breaking devices 160, 161, or 162. These particle breaking devices could be focused ultrasonic transducers or laser diodes. Particle breaking devices are preferably used to pulverize sand, or other particles passing into the flow lines, into smaller size particle, for example, for avoiding plugging of component of the testing tool. These devices may use different energy/frequency levels to target various grain sizes. For example, particle breaking device 162 may be used to break produced sand during a sampling operation. In some cases, the readings of downhole sensor 131 will be less affected by pulverized particles than larger size particles. In another example, particle breaking device 163 may be used to break particles in suspension in the drilling mud during an injection (fracturing) operation. In some cases, pump 130 will be able to handle pulverized particles more efficiently and will not plug, leak or erode as fast as with larger size particles in the mud. Particle breaking devices may be used for other applications, such as transferring heat to the flow line fluid.

While testing tool 10, as shown in FIG. 2, is build in a modular fashion, those skilled in the art will appreciate that all the components of tool 10 may be packaged in a single housing. Also, the arrangement of the modules in FIG. 2 may be modified. For example, fluid analysis module 151 shown above pump module 152 may alternatively be located between pump module 130 and carrier module 153. In some situation, tool 10 can have additional (or fewer) operational capabilities beyond what is discussed herein. The tool can be used for a variety of testing, sampling and/or injection operations using the selectively enabled packer elements as discussed herein.

Figure 3:
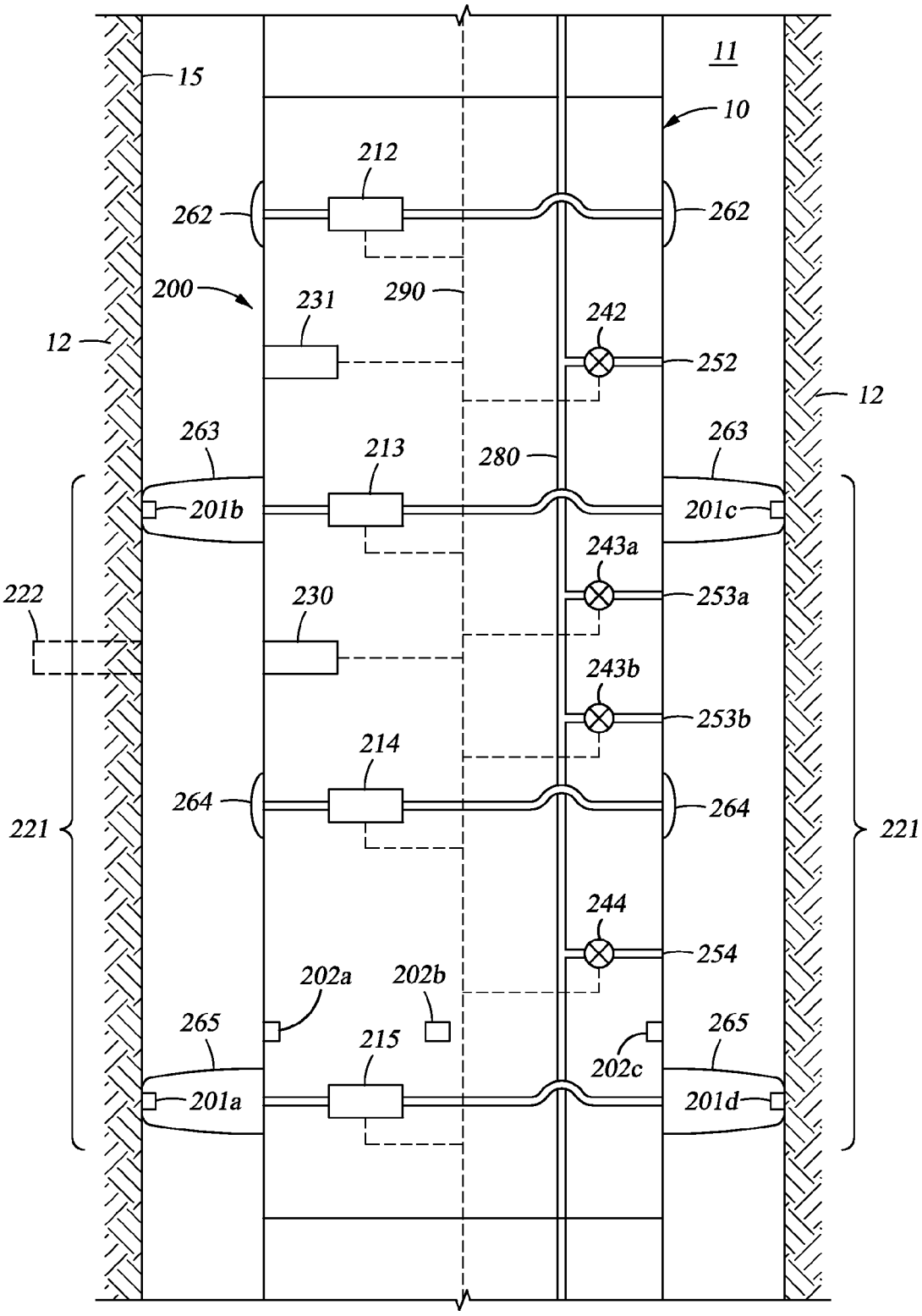
FIG. 3 is a schematic illustrating the selective length adjustment of a sealed wellbore interval with a tool having a plurality of spaced apart packer elements.

FIG. 3 shows in more details an embodiment of packer module 200 similar to module 100 of FIG. 2, where two of the four packer elements have been inflated. Packer module or tool portion 200 may comprise one or more flow line 280, similar to flow line 180 in FIG. 2. Flowline 280 is selectively connected to one or more port(s) in the tool, such as ports 252, 253*a*, 253*b* and 254 via associated valves 242, 243*a*, 243*b* and 244 respectively, allowing fluid to flow from or into flow line 280. Each interval between packer elements 262, 263, 264 and 265 has preferably at least one port. Although shown on the same side of the tool, ports may be located anywhere around the tool. Packer module or tool portion 200 may also comprise packer inflation devices 212, 213, 214 and 215 for selectively inflate or deflate packers 262, 263, 264, and 265 respectively. Other means to extend packers into sealing engagement with the wellbore wall may also be used without departing from the invention. Inflation devices 212, 213, 214 and 215 may consist of one or more pump (s), controlled by a controller (not shown) via bus 290, similar to bus 190 of FIG. 2.

Note that testing tool 10 may not be modular. In this eventuality FIG. 3 would represent a portion of testing tool 10. Note also that the concepts discussed herein are not limited to four packer elements. Any number of packer elements may be deployed on a tool and selectively inflated depending on desired results and the operations to be performed. Also note that the packer elements need not be all of the same type or spaced equidistant from each other.

Each of the packers 262, 263, 264 and 265 can be inflated so that the packers radially expand and contact wellbore wall 15 of formation 12. By expanding at least two of the packers sufficiently to contact the wellbore wall, the interval of the wellbore between the two inflated packers can be sealed off from the rest of the wellbore. Thus, as shown in FIG. 2, packers 263 and 265 have been selectively inflated to form a sealed interval 221 between packers 263 and 265. The sealed interval allows, for example, formation fluid to be drawn into the tool for testing. The selective enabling of each packer can be, for example, by expanding the packer under the control of inflation devices 212, 213, 214 and 215 by hydraulic lines extending into the packer element. Note that while each packer is shown with an individual inflation device, a device common to each packer can be used. Also, the force for enabling the packers can come from the surface or from another tool, if desired.

Other packers may be selectively extended to seal wellbore intervals of various lengths. An interval length may be selected downhole, for example by analyzing measurements performed by sensors of tool 10 or from another tool in the tool string. A measurement that may be used in some cases could be a wellbore resistibility image. By way of example, the longest testing interval may be selected. Sampling a long interval of wellbore wall in this way could result in a lower drawdown pressure. The user (or some logic implemented downhole) would then enable packers 262 and 265, for example by activating inflation devices 212 and 215 through bus 290. Packers 263 and 264 would not be enabled and would remain retracted (deflated). By extending packers 262 and 265, the wellbore interval between top packer 262 and bottom packer 265 would be sealed. Testing would follow. For example, this may include injecting or drawing fluid from any of the ports 252, 253*a*, 253*b* or 254 by opening any of the associated valves 242, 243*a*, 243*b* or 244 respectively. Alternatively, a short testing interval may be selected. Sampling a short interval of wellbore wall in this way could result in a more homogenous fluid. For example, it may be desirable to only test an interval having a length almost equal to the distance between packers 263 and 264. This can be done by extending packers 263 and 264 toward the wellbore wall and sealing the corresponding interval. Note that by having non-equal spacings between three or more packers, the user can choose among a variety of interval length to be sealed and test the formation.

In some testing applications, monitoring the flow of fluids in the formation (injected from the tool or drawn into the tool) may be desirable. In some situations, it can be advantageous to have sensors, such has sensors 201, close to the wellbore wall 15. In one embodiment, sensors 201*a*, 201*b*, 201*c* and 201*d* may be located directly on the packers. These sensors can measure various formation or fluid properties while the tool is in the wellbore. For simplification, FIG. 3 illustrates sensors 201*a*-201*d* only on packers 263 and 265. However, the sensors may also be located on any or all of the packers. In addition to locating the sensors on the packers, other sensors 202, such as sensors 202*a* 202*b*, and 202*c*, may be located on or within the tool at any location. Some of these sensors 201, 202 may measure fluid properties (such as pressure, optical densities) while others may measure formation properties (such as resistivity). Data gathered by sensors 201*a-d* and 202*a-c* (and other sensors) may be communicated via bus 290 to a controller (not shown) similar to the controller 140 of FIG. 2. The data sent to the controller may further by processed downhole by a processor, similar to the processor 140*a* of FIG. 2. The controller may further adjust operations of the tool 10, for example modify the pumping rate of pump 130 or modifying the length of the sealed interval, based on the processed data. Data gathered by sensors 201, 202 may also be stored downhole into a memory, similar to the memory 140*b* of FIG. 2, or sent uphole for analysis by an operator via a telemetry system, similar to the telemetry system 140*c* of FIG. 2.

Perforation may be desirable for some testing applications. Thus, the formation may further be perforated at a point within the sealed off interval of the wellbore, for example, for altering the fluid flow from the formation to the sealed interval of the wellbore between the two inflated packers. Any kind of perforation device may be mounted between two inflatable packers, such as perforation guns 230 and 231. For example, a bullet fired from a perforating gun 230 may be used to perforate formation 12 as shown in FIG. 3 to create a perforation 222. The bullet may hold a sensor capable of sending data to tool 10, for example using an electromagnetic wave communication.

Figure 4:
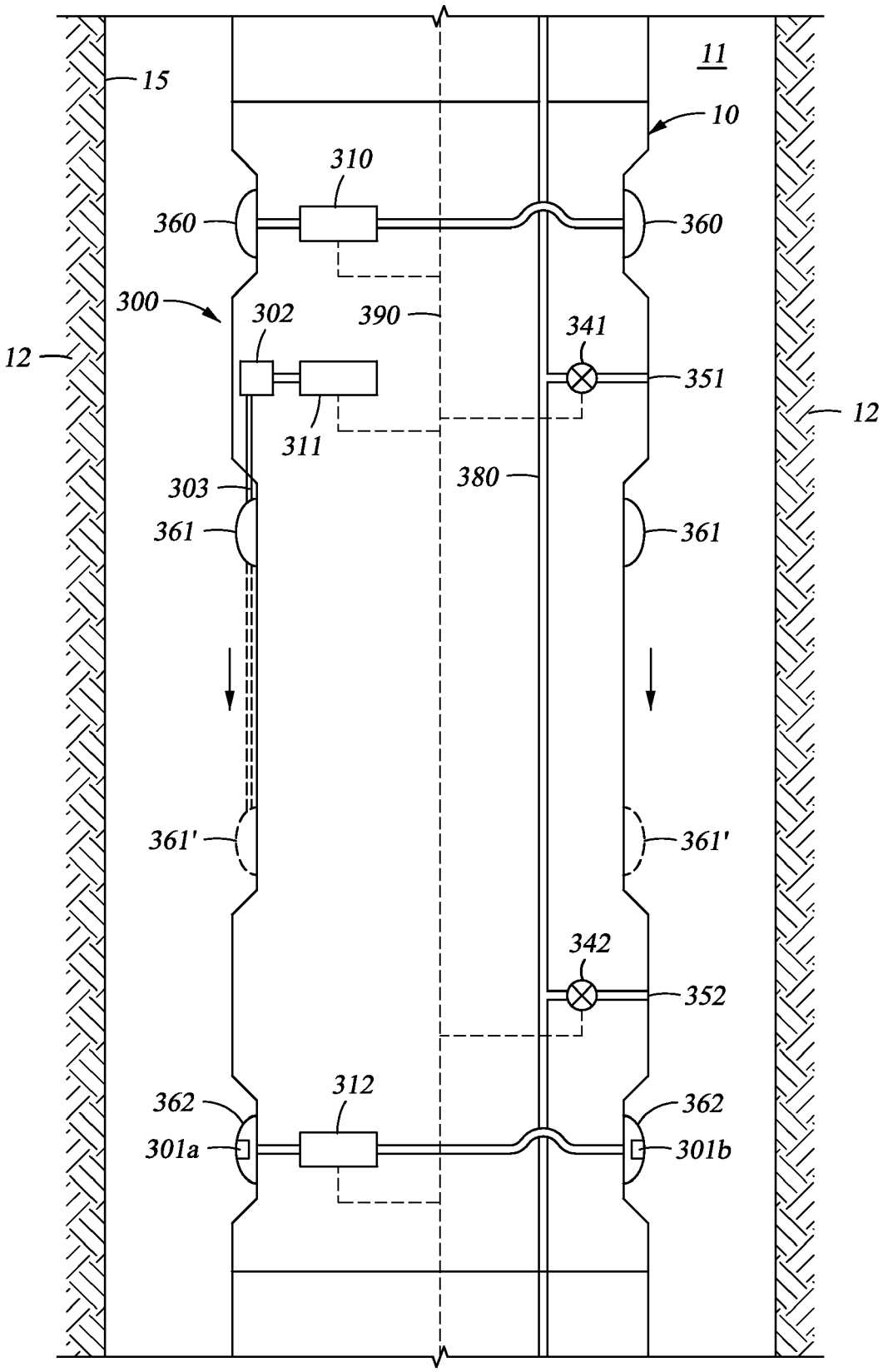
FIG. 4 is a schematic illustrating the selective adjustment the length of a sealed wellbore interval with a tool having a slidable packer element.

FIG. 4 shows another embodiment of a testing tool capable of selecting in situ the length of an interval to be sealed. Thus, FIG. 4 illustrates the selective length adjustment of a sealed wellbore interval by sliding a packer element along the length of the tool to vary the distance between two packer elements. Referring to FIG. 4, packer module 300 similar to packer module 100 of FIG. 2 is shown. Packer module 300 is shown with three packer elements 360, 361 and 362 but any number of packers could be employed. These three packer modules are operatively coupled with three inflation devices 310, 311 and 312 respectively for selectively extending (inflating) and recessing (deflating) the three packer elements. In the embodiment of FIG. 4, the middle packer 361 is shown to be slidably movable along the longitudinal axis of the tool 10. Packer element 361 is coupled to piston actuator 302 which may be utilized to slide packer 361 up or down the length of the tool body. For example, actuator 302 could be used to move packer 361 to position 361'. The fluid for inflating/deflating the packer could be delivered by inflation device 311 to packer 361, for example, via hydraulic line located in ram 303 (not shown).

In operation, testing tool 10 of FIG. 4 would be lowered into formation 12 traversed by wellbore 11. The length of an interval of wellbore 11 to be sealed can be determined in situ. For example, a Nuclear Magnetic Resonance measurement can be used to estimate the viscosity of the formation fluid surrounding tool 10, and the length of the interval to be sealed for a sampling operation may be adjusted therefrom. The piston actuator 302 may then be activated for sliding packer element 361 along the tool body for adjusting the distance between packer element 360 and packer element 361. For example, once the length is selected (packer element 361 is moved to position 361' on FIG. 4), packer elements 360 and 361 may be extended (inflated) toward the wellbore wall 15 by inflation devices 310 and 311, sealing thereby an interval of the wellbore which length is substantially equal to the selected length. Testing may then begin. For example, fluid may be drawn into the tool through port 351. The testing step may involve manipulating valves, such as valve 341. Fluid may be flown into flowline 280 (similar to flowline 180 in FIG. 2). When testing is finished, packers are usually deflated below the outer surface of the testing tool.

The embodiment shown in FIG. 4 can be combined with the embodiment shown in FIG. 2 or FIG. 3, such that packers 102, 103, 104 and 105 (FIG. 2) may all be slidably moved along the tool such that it is possible to vary the vertical distance between any two packers. As an example, it may be desirable to test a region of an earth formation larger than that covered by the area between packers 102 and 103 but not as large as the areas covered by packers 102 and 104. In this case, packer 102 could be moved upward in the vertical direction along the tool to expand the top area, or packer 103 may be moved downward in the vertical direction along the tool to expand the area downward. The ability to selectively move packers in the vertical direction along the tool provides an infinite number of testing regions within the well.

Note that some packers may be slidable and some may not, as shown in FIG. 4 by non slidable packer 360 and 362, and slidable packer 361. Note also that slidable and non slidable packers may be arranged in various combinations. Although the operation of testing tool 10 of FIG. 4 has been described using packer element 360 and 361 to seal an interval with a length selected downhole, packer 361 and 362 may be used instead, and fluid may alternatively be flown through port 352 (and open valve 342) on tool 10.

Figure 5A:
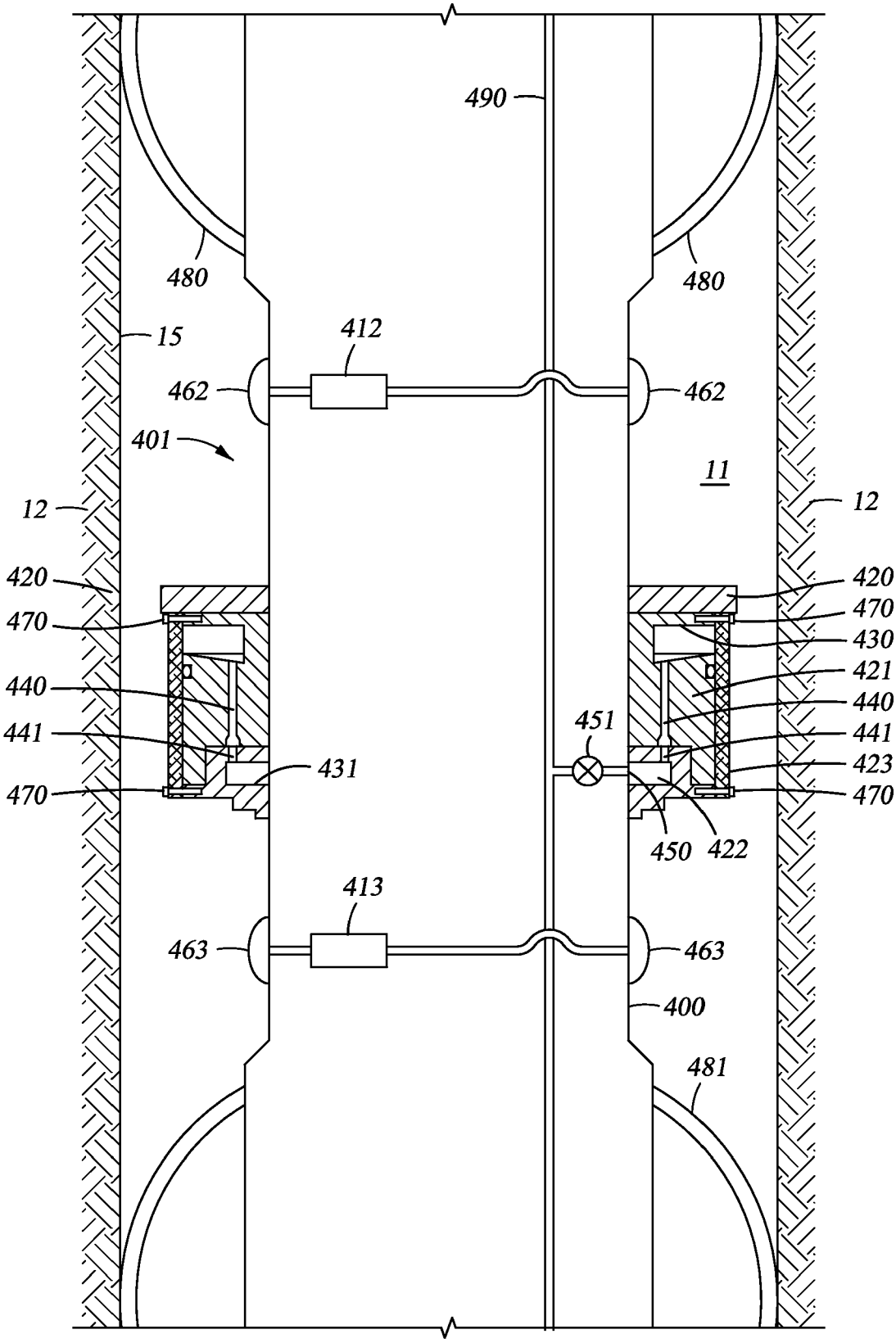
FIGS. 5A-5B cross sectional views showing embodiments of a snorkel assembly adapted to a testing tool.
Figure 5B:
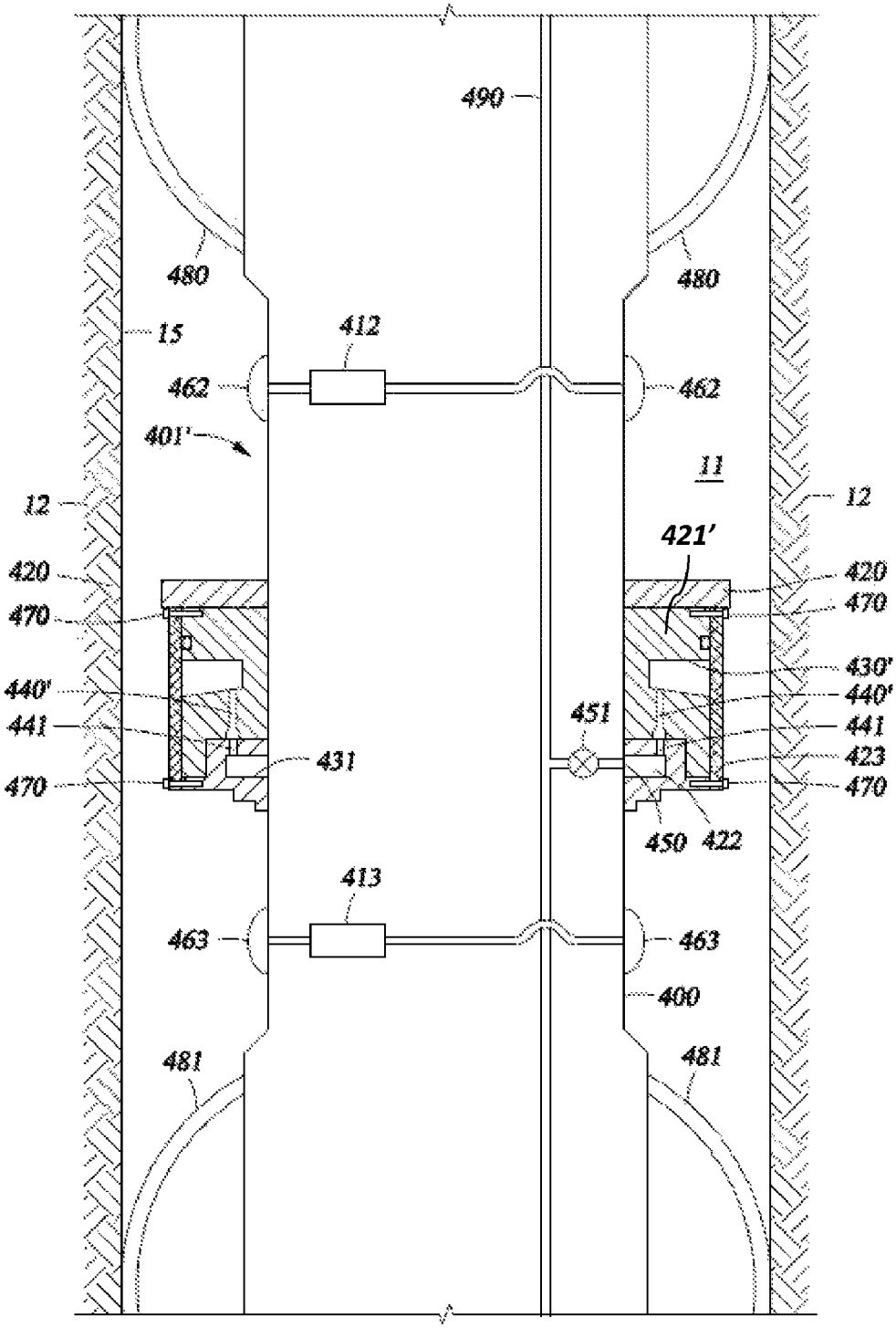

FIGS. 5A-5B show embodiments of a snorkel assembly 401 (FIG. 5A) and 401' (FIG. 5B) adapted to a testing tool 10. The snorkel assembly may be used to advantage for bringing a port of the sampling tool to a more effective relative position with respect to the packer elements. FIG. 5A-5B show a packer module 400 adapted on a testing tool 10 lowered in a wellbore 11 penetrating a formation 12. Note that the testing tool is shown partially, and may be similar to the testing tool of FIG. 2. The testing tool 10 may include centralizer bow springs 480 and 481 as known in the art. The packer module 400 comprises packer elements 462 and 463 for sealing an interval of the wellbore 11 by extending (inflating) the packer elements into sealing engagement with the wellbore wall 15, for example with inflation devices 412 and 413 respectively. The packer module 400 may further comprise a port 450 on the tool body and an associated valve 451. The port allows for fluid communication between a flow line 490 in the downhole tool, similar to flow line 180 in FIG. 2, and a sealed interval of the wellbore. In the examples of FIGS. 5A-5B two different snorkel assemblies 401 and 401' respectively, are adapted on the testing tool 10. The snorkel assembly 401 or 401' may comprise a filter 423, an adapter 422, a snorkel 421 (FIG. 5A) or 421' (FIG. 5B), and a ring 420. Note that the snorkel assembly may comprise additional parts, such as sensors, for providing other functionalities. Note also that the snorkel assembly may comprise fewer parts. For example the filter 423, the ring 420, may be optional.

The snorkel assembly is preferably adaptable on the testing tool 10. For example, while the packer module 400 is disconnected from the testing tool 10, and the packer element 462 is not mounted on the packer module, the adapter 422 may slide around the packer module body and rest on the mounted packer 463. When the adapter 422 is place, the port 450 of the tool is fluidly connected to annular groove 431. Then the snorkel 421 or 421' is slid on top of the adapter 422. Snorkel 421 (421') comprises one or more fluid communication(s) 440*a*-440*e* (440'*a*-440'*e*) between a snorkel port 430 (430') and annular groove 431 via passageway 441. In the example of FIGS. 5A-5B, fluid communication(s) 440*a*-440*a* comprise a plurality of flow lines, for example 8, distributed around the circumference of the snorkel. A screen filter 423 may then slide around the snorkel and may be held in place with screws 470 or other fasteners. The filter 423 preferably covers the snorkel port 430 (430'). A ring 420 may finally be slid on the tool mandrel and locked in place before the packer element 462 is mounted. The packer module 400 is further included into testing tool 10. The testing tool 10 may be lowered into a wellbore to perform a test on a subterranean formation.

Different snorkel designs may have different snorkel port configurations. The snorkel design that is adapted on tool 10 is preferably chosen such that the snorkel port configuration is adjusted for a particular testing operation. In the example of FIG. 5A, the snorkel port 430 is shown higher than the snorkel port 430' of FIG. 5B. Also the snorkel port shape may be adjusted from one snorkel design to another. Thus, if a snorkel port configuration such as shown by 430 is desirable for testing, an operator may adapt the snorkel 421 to the testing tool 10, adjusting thereby the initial configuration of the port on the testing tool 450 to the desired configuration of the snorkel port 430. In other cases, a different snorkel port configuration, such as shown by 430', may be desirable for testing. Here again, an operator may adapt a different snorkel to the testing tool 10, adjusting thereby the initial configuration of the port on the testing tool 450 to the different configuration of the snorkel port 430'.

Screen filters with various characteristics can be assembled in the snorkel assembly. In some cases, the screen filter may comprise two or more screens. In some cases, the screens may be separated by a small gap. Also the screens can be reinforced, for example by vertical strips. The screen filter characteristics are preferably adjusted for the testing operation the tool is intended to perform.

Note that a snorkel assembly can be adapted to any kind of testing tool, such as the testing tool of FIG. 2, 3 or 4. Note also that the snorkel in the snorkel assembly could be made telescopic and may be adjusted downhole using an actuator.

Figure 6A:
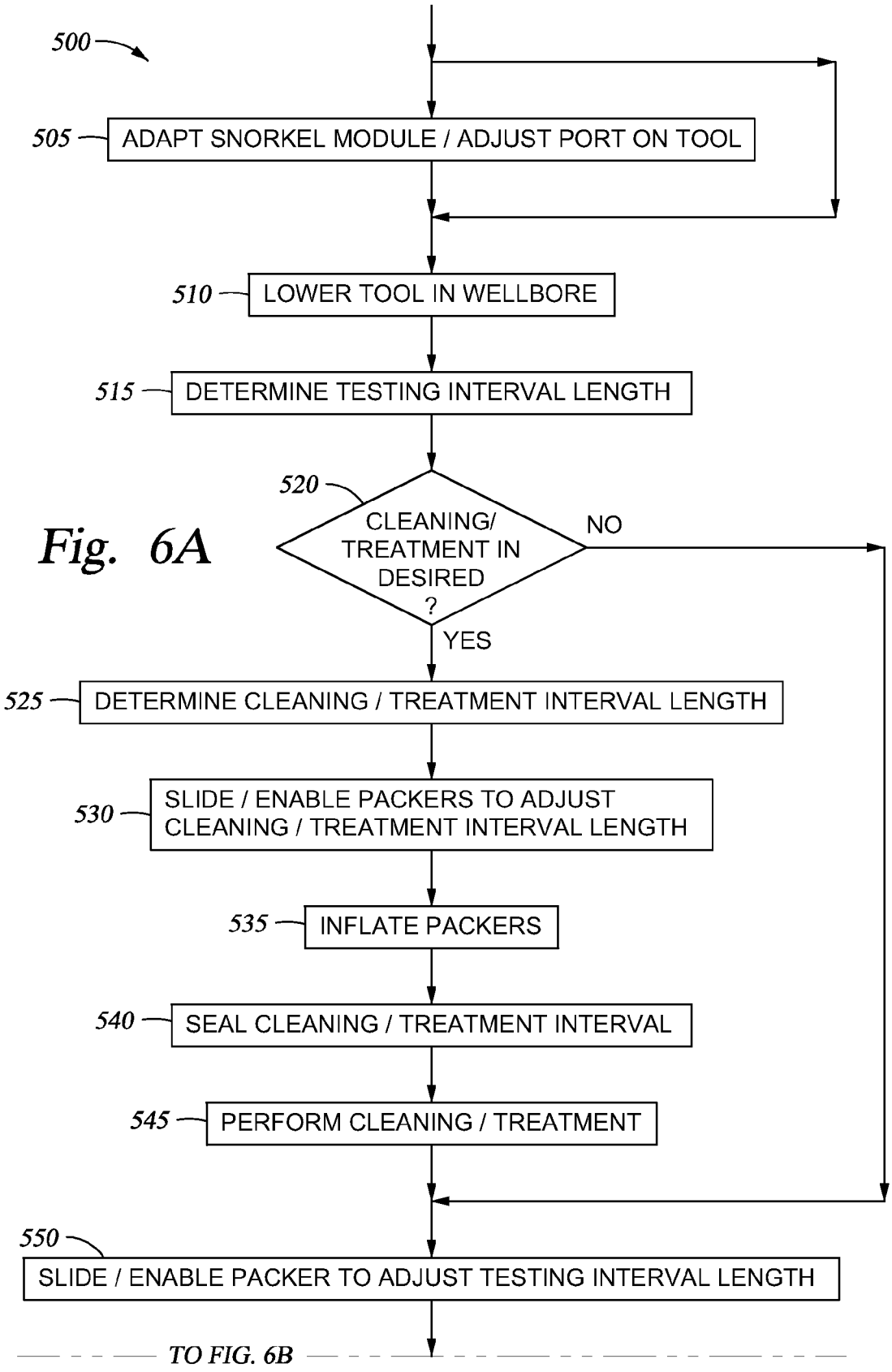
FIG. 6 is a flow chart describing the steps involved in one embodiment of a method for testing a subterranean formation.
Figure 6B:
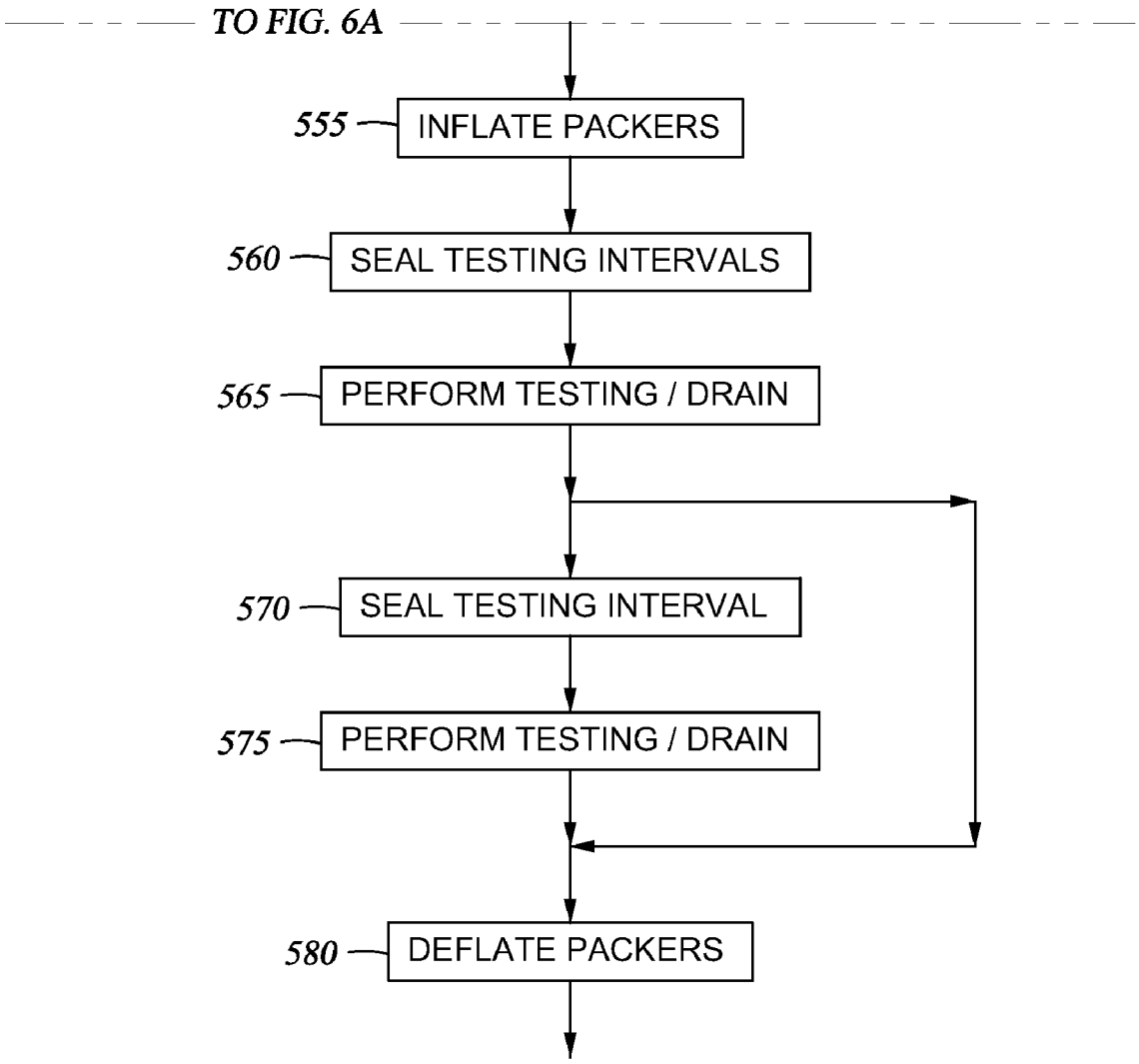

FIG. 6 describes one embodiment of a method 500 for testing a subterranean formation. The method 500 preferably utilizes a testing tool having a tool body, a plurality of packer elements spaced apart from one another along the longitudinal axis of the tool body, and at least a testing port on the tool body located between two packer, as is the described herein. However, the method 500 may be used with any testing tool having selectively-activated packer elements and capable of formation testing.

Figure 9A:
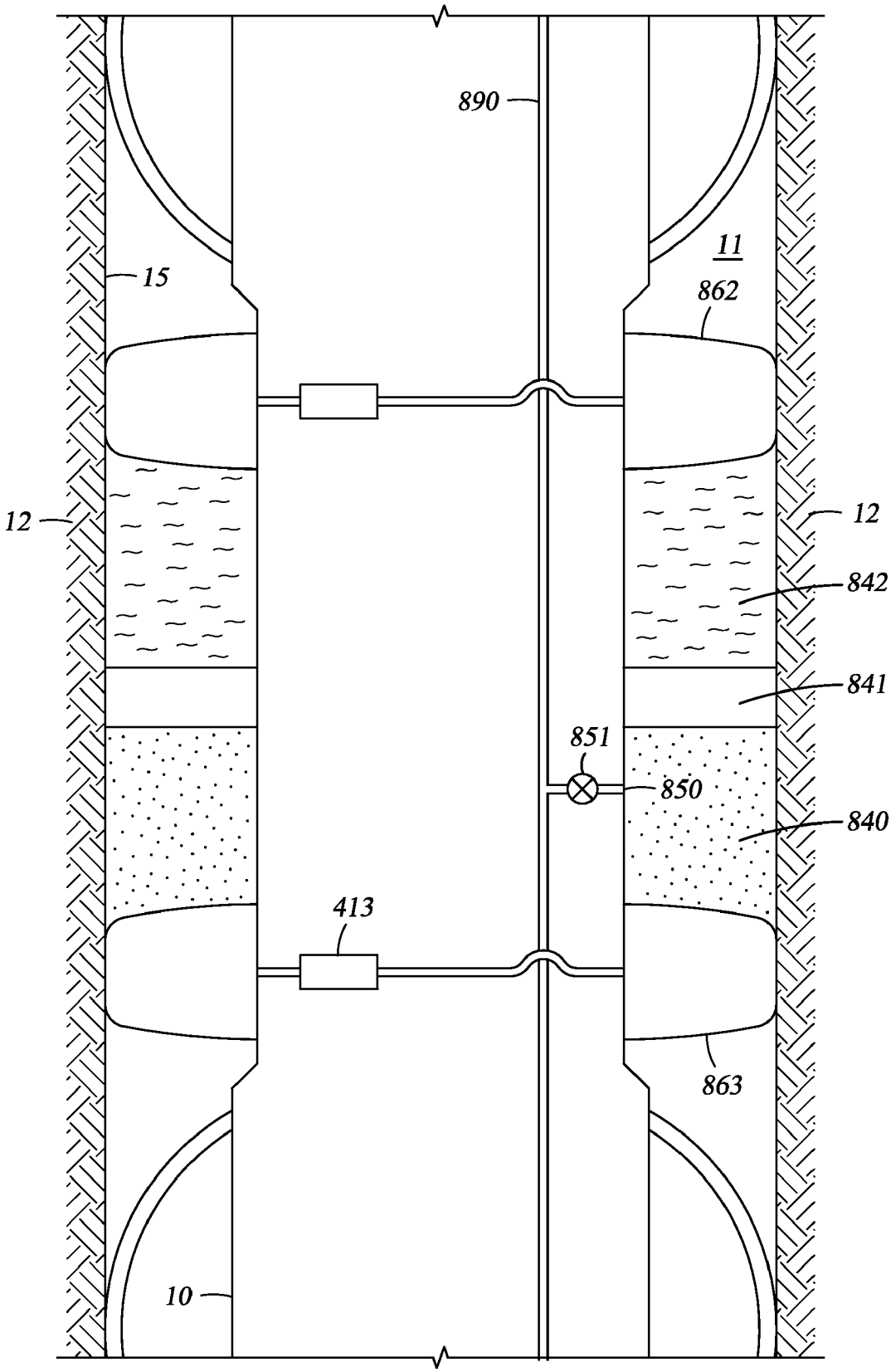
FIGS. 9A-9B are schematics illustrating yet another method for testing a subterranean formation.
Figure 9B:
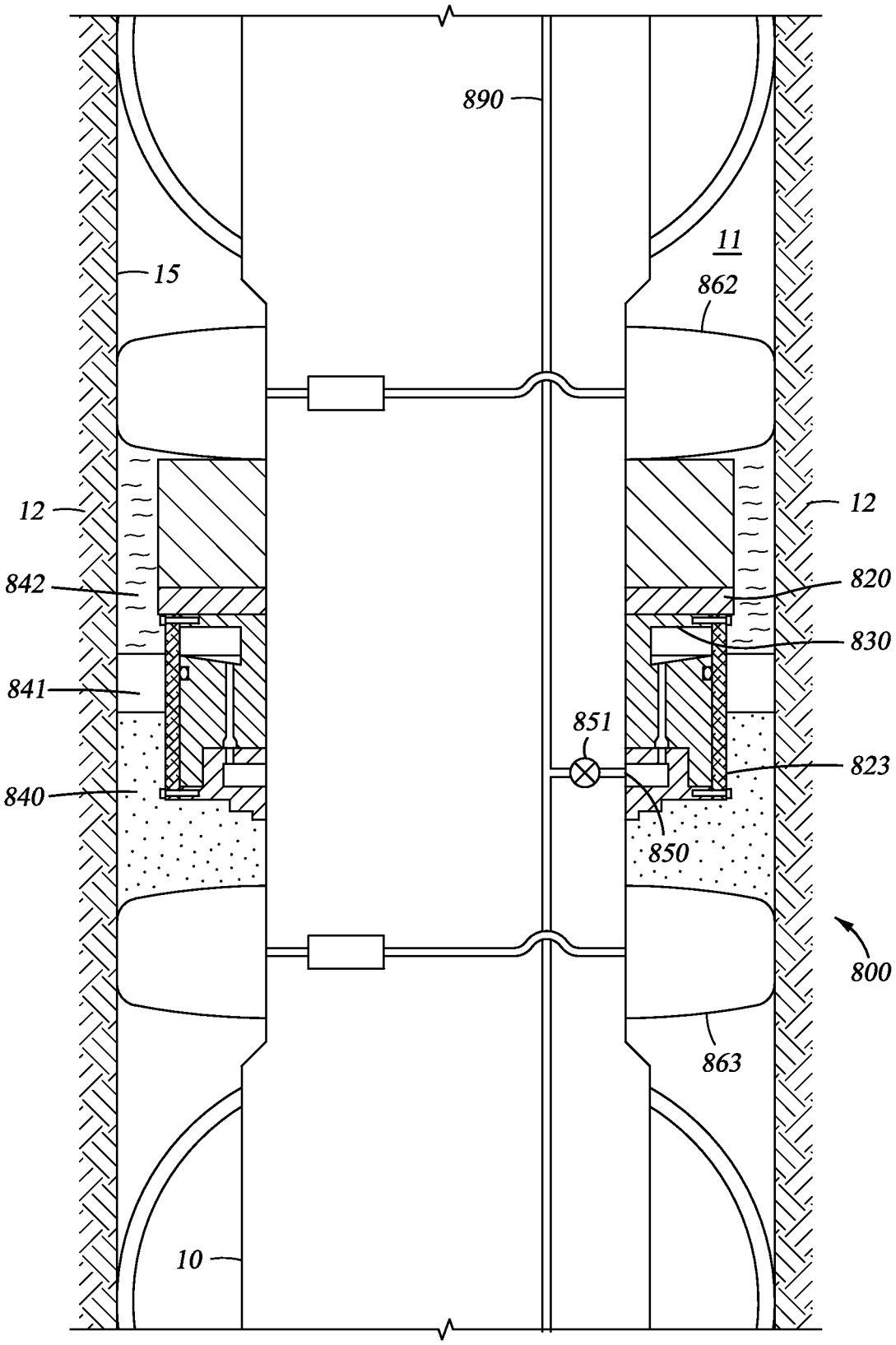

In optional step 505, a snorkel assembly is placed on the testing tool. The snorkel assembly is capable of adjusting a port on a testing tool. The snorkel assembly may also be capable of adjusting the characteristic of a filter screen. The snorkel may further be capable of reducing the volume trapped in the sealed interval. For example, the testing tool may be intended to sample formation fluid in an unconsolidated formation, and the formation fluid is expected to have a lower density than the borehole fluid. The testing tool may also be intended for a large diameter wellbore. Such sampling situation is illustrated in FIG. 9A-9B for explanatory purposes. Note that in step 505 of method 500, the testing tool is not yet lowered into the borehole, and FIG. 9A-9B are used therebelow to explain how the testing tool is expected to perform in the sampling situation discussed above, based on an prior knowledge of the sampling conditions, and how the adjustment of step 505 may be performed.

Referring to FIG. 9A, a portion of testing tool similar to testing tool 10 of FIG. 2 is shown in a wellbore 11 traversing a formation 12 during a sampling operation. Packer elements 862 and 863 are shown in an extended position, and engaged with the wellbore wall 15 for sealing a wellbore interval therebetween. In the example of FIG. 9A, the testing tool 10 has drained fluid from the wellbore into flowline 890 (similar to flow line 180 of FIG. 2) through tool port 850 and open valve 851. The fluid drained from the wellbore has been partially replaced by formation fluid 842, and sand or debris 840 produced from the formation. Note that some wellbore fluid may still be present in the sealed interval, as shown by 841. The illustration of FIG. 9A assumes that debris, wellbore fluid and formation fluid have segregated in the order as shown, because of density contrast between these materials, but segregation may occur in different order. During the sampling operation shown in FIG. 9A, sand or debris may enter tool port 850 and plug, clog or erode various components in testing tool 10, such as pump, or valves. Also, debris may cause noise at a fluid property sensor. Finally, the volume of the sealed interval may be large, because the testing tool is run in a wellbore of large diameter. Because of this large volume, the sampling operation may require a long time before formation fluid enters in the testing tool and is available for capture in a cavity. This long sampling time may increase the probability of the testing tool to become stuck in the wellbore.

Turning now to FIG. 9B, a snorkel assembly 800 is shown in a wellbore 11 traversing a formation 12 during a sampling operation as shown in FIG. 9A. In FIG. 9B the location of the tool port 850 has been adjusted for this particular operation by adapting a snorkel assembly to the testing tool prior to lowering it into the borehole. Fluid is now drawn from the wellbore at the snorkel port 830, that is located above the debris that has segregated on top of the lower packer element 863, reducing thereby the probability of components of the tool 10 being plugged by debris entering the testing tool 10. Note also that the snorkel port is located close to the upper packer element 862, reducing thereby the volume and the time needed to draw into the tool formation fluid that have segregated above the wellbore fluid. In the example of FIG. 9B, the snorkel assembly also comprises a filter screen 823, whose characteristics such as the area, the screen mesh size, the number of screen layers or the screen collapse resistance may have been adjusted to the sampling operation. For example, the screen filter 823 may be chosen to be a double layer filter, or may be reinforced by vertical stripes between the layers to insure a high collapse resistance. The snorkel port 830 may further extend around the entire circumference of the tool, increasing thereby the area of the intake adjacent to the filter screen, which may be advantageous for avoiding plugging of the filter screen. In the example of FIG. 9B, the outside diameter of the snorkel module has been selected so that the trapped volume of fluid between packer element 862 and 863 is reduced with respect to FIG. 9A. Specifically, the outside diameter is selected just below the wellbore diameter. Reducing the trapped volume of fluid may decreases the volume of fluid needed to be pumped before formation fluid enters the tool and decreases the time needed to capture a formation fluid sample. Note that the volume may also be reduced by using rings, such as ring 820.

Turning back to FIG. 6, the testing tool is lowered in the wellbore in step 510. As mentioned before, the testing tool may be conveyed on a drill sting, a tubing string, a wireline cable or any other means known by those skilled in the art. Lowering the downhole tool may comprise drilling or reaming the wellbore. The wellbore may be open to the formation or may be cased. If the wellbore is cased, the testing tool preferably comprises perforation devices, such as drilling shafts or perforating guns, for example located between two packer elements. The testing tool may be lowered in the wellbore with other tools, such as formation evaluation tools known by those skilled in the art. The conveyance means preferably comprises a telemetry system capable of sending information collected by a downhole tool to the surface, and receiving commands from the surface for controlling operation of the testing tool. A downhole controller executing instructions stored in a downhole memory in the testing tool may also control operations of the testing tool.

Step 515 in FIG. 6 determines the length of the wellbore interval to be tested. This can be achieved downhole, for example using a processor and data collected by sensors. This can alternatively be achieved under control of a user operating from the surface, for example, using a camera or other sensing tools, not shown, which are part of the downhole tool string. This can be alternatively achieved by any other methods and/or sensors mentioned therein. Other methods and/or sensors may also be used without departing from this invention. The method may comprise the optional step 520, that determines whether cleaning is desired within the testing interval. Cleaning may comprise delivering materials conveyed from the surface in one of the cavity of testing tool 10, such as cavity 150-1 of FIG. 2, into the wellbore, for example for dissolving locally the mudcake on the wellbore wall 15. This material could be water, steam, solvent or any combination thereof. If cleaning is desired, optional step 525 determines the length of a cleaning interval to be sealed, usually comprising the testing interval so that the cleaning material can be fully removed from the testing interval as further discussed below. The cleaning interval length may be selected by enabling the extension of two packer elements from the plurality of the packer elements carried by the testing tool in step 530. Note that the adjustment of the testing interval length may alternatively be achieved by sliding packer elements along the axis of the tool prior to extending the packer element toward the wellbore wall, as previously discussed with respect to FIG. 4.

As a way of example, FIGS. 7A-7D show a portion of a testing tool similar to testing 10 of FIG. 2, lowered in a wellbore 11 traversing a formation 12. The testing tool 10 comprises packer elements 602, 603, 604 and 605, and ports 652, 653, and 654. In the example of FIGS. 7A-7D, the extension of packer elements 602, 603, 604 or 605 can be selectively enabled, for example using the apparatus described in more details with respect to FIG. 3. As a way of example, the length of the wellbore interval to be sealed determined in step 510 may be represented by interval 610 on FIGS. 7A and 7D. As a way of example, the length of the wellbore interval to be sealed determined in step 525, may be represented by interval 611 on FIGS. 7B and 7C.

Turning back to FIG. 6, packer elements of the testing tool are extended toward the wellbore wall in step 535 if cleaning is desired. A first interval, the cleaning interval, is sealed from the rest of the wellbore in step 540. Note that in some cases it may be advantageous to bypass one of the sealing packer element with a flow line (not shown) in the testing tool that establishes a fluid communication between the sealed interval in step 540 and another part of the system, for example the wellbore outside the sealed cleaning interval. Optional cleaning or treatment is performed in step 545.

Figure 7B:
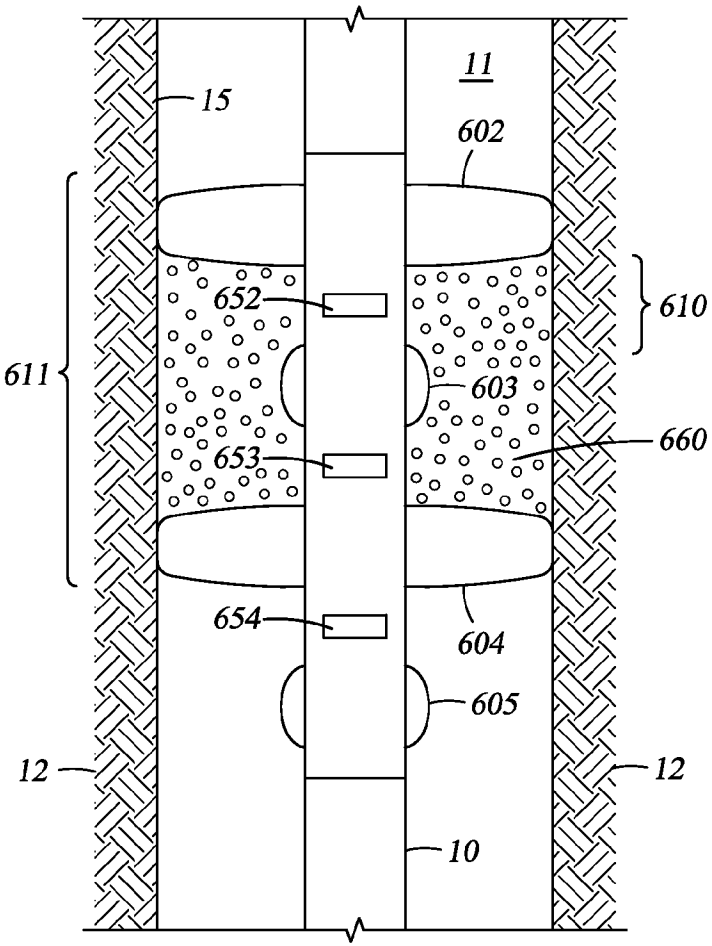
FIGS. 7A-7D are schematics illustrating a method for testing a subterranean formation.
Figure 7A:
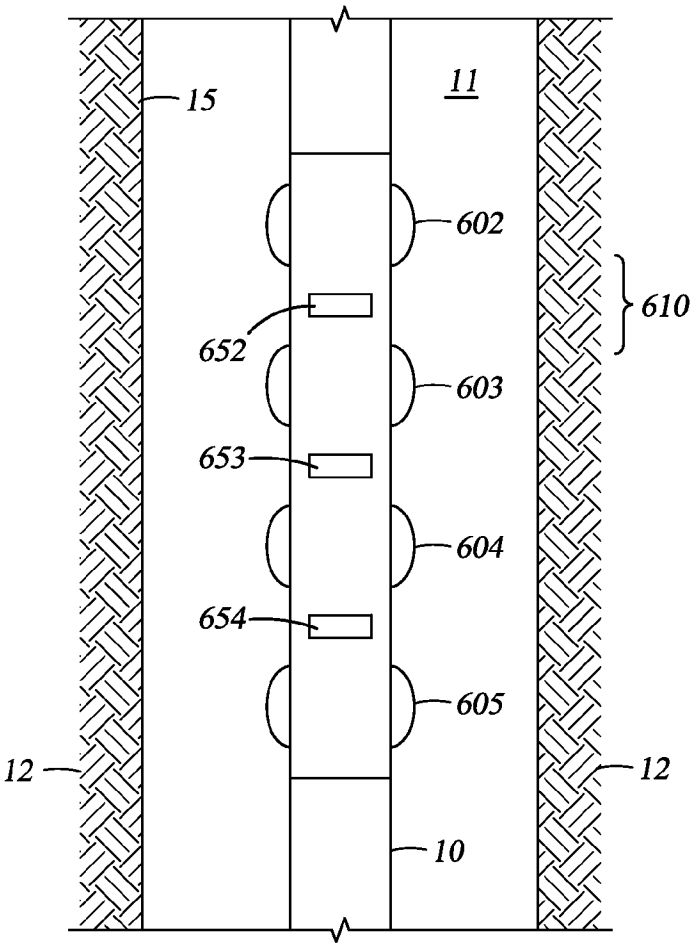
Figure 7D:
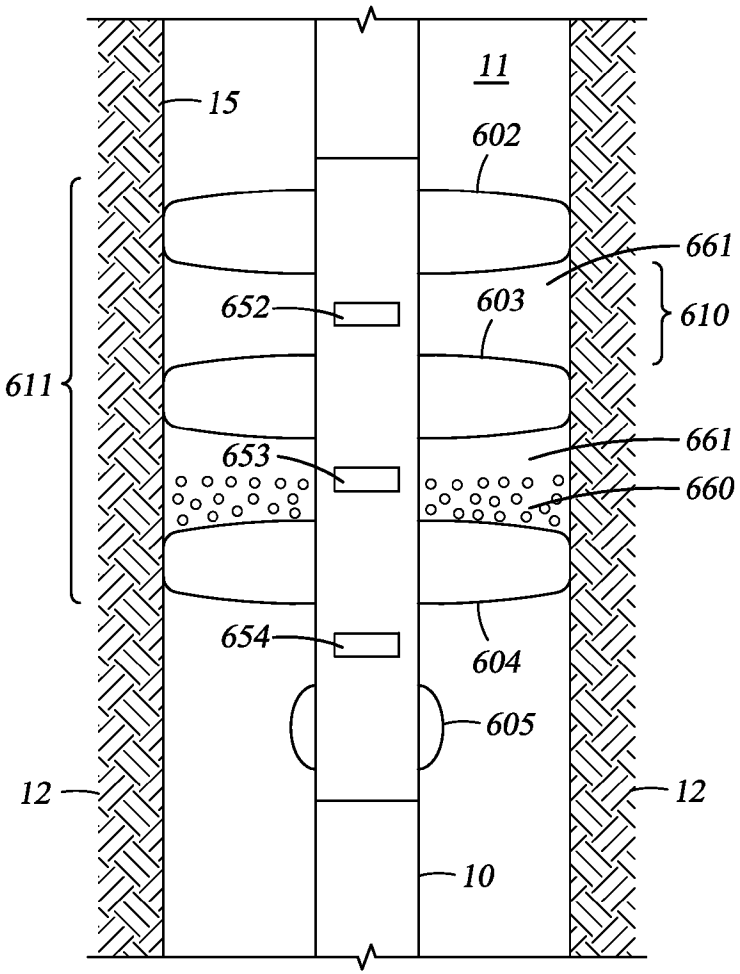
Figure 7C:
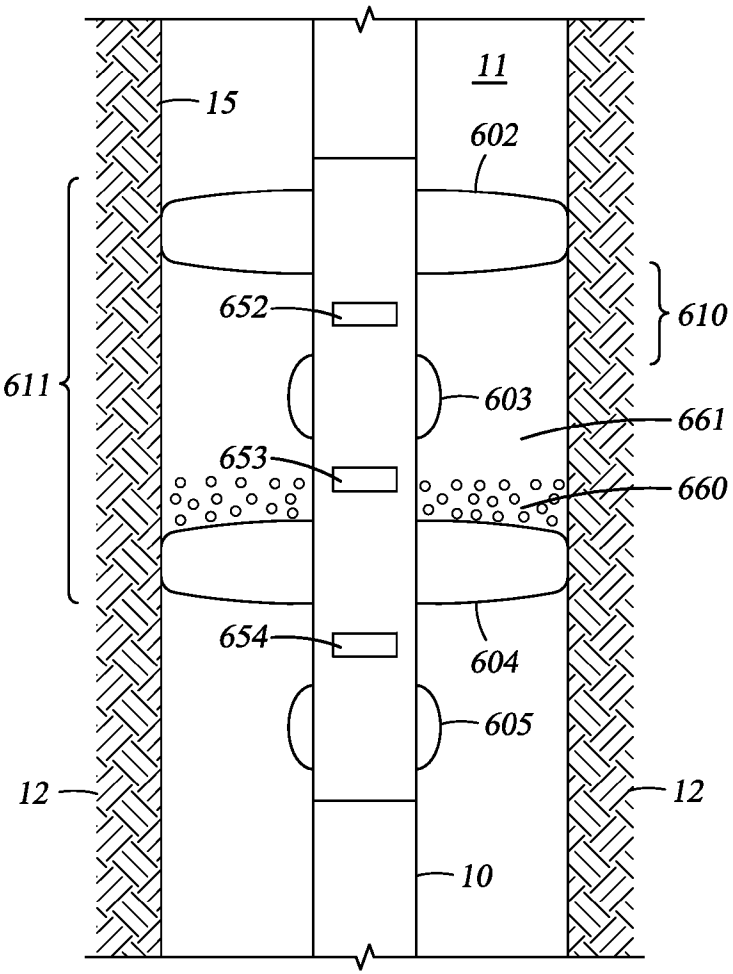

In the example of FIGS. 7B and 7C, the interval length may be selected by enabling the extension of two selected packer elements from a plurality of packer elements carried by the testing tool. Packers 602 and 604 are first enabled and then extended (inflated) in step 535 of the method shown in FIG. 6. By extending toward the wellbore wall, packers 602 and 604 seal the cleaning interval 611 which length is roughly equivalent to the determined length in step 525 of the method shown in FIG. 6. A cleaning fluid 660 may then be injected through port 652 or 653 into the wellbore in step 545 of the method shown in FIG. 6. Preferably the cleaning fluid 660 will occupy a large portion of the cleaning interval, as indicated by cleaning fluid 660 in FIG. 7B. Sensors, similar to sensors 202*a-c* or 201*a-d* shown in FIG. 3, or other sensors, may optionally monitor the cleaning process, and the cleaning process may be controlled based on the sensor signals. Step 545 may further comprise draining the cleaning fluid 660, for example in port 653 as shown in FIG. 7C. This cleaning fluid may be dumped into the wellbore outside the sealed interval, for example at port 163 of FIG. 2, or stored in a cavity in the testing tool, such as cavity 150-2 of FIG. 2. Usually, draining through port 653 will not efficiently remove the cleaning fluid 660 located between the lower packer element of the sealed interval 604 and the draining port 653. Note that in the example of FIG. 7C, it is assumed that the density of the cleaning fluid and/or cleaning debris is larger than the density of the formation fluid. It is further assumed that the testing tool 10 is operated such that formation fluid is drawn from the surrounding formation as cleaning fluid is drained outside the cleaning interval, as shown by formation fluid 661. Thus, formation fluid and cleaning fluid may segregate by gravity as shown in FIG. 7C. In the case the formation fluid density is higher than the cleaning fluid and/or cleaning debris density, the sequence of formation fluid, cleaning fluid, and/or cleaning debris may be different. Note also that this invention is not limited to the presence of two segregated fluids in the sealed interval.

Turning back to FIG. 6, the testing interval length may be selected by enabling the extension of two packer elements from the plurality of the packer elements carried by the testing tool in step 550. Note that the adjustment of the testing interval length may alternatively be achieved by sliding packer elements along the axis of the tool prior to extending the packer element toward the wellbore wall, as previously discussed with respect to FIG. 4. Packer elements of the testing tool are extended toward the wellbore wall in step 555. Note that if a first cleaning interval has already been sealed, it may be advantageous in some cases to maintain the first interval sealed while sealing a second interval, the testing interval. Thus, it may be advantageous to bypass one of the sealing packer element with a flow line (not shown) in the testing tool that establishes a fluid communication between the cleaning interval and another part of the system, for example the wellbore outside the sealed cleaning interval. This would allow for the fluid displaced by the extension of a third packer element in the sealed interval to be vented out of the sealed interval. A testing interval is sealed from the rest of the wellbore in step 560. Testing of the formation is performed in step 565, for example injection, or sampling, preferably in a manner known in the art.

Continuing with the example of FIG. 7D, the testing interval 610 is selected by enabling the extension (inflation) of packer element 603 between already extended packer elements 602 and 603 (step 550 of the method in FIG. 6). Note, that in this scenario packer element 602 would be enabled for both sealing the testing volume and the cleaning volume. The testing interval 610 is sealed once the packer element 603 reaches the wellbore wall. Thus, the testing interval 610 is now isolated from the residual cleaning material and/or debris 660 above the lower packer 604. The residual cleaning material and/or debris 660 is retained below expanded packer 603 and is trapped, so as not to contaminate the fluid contained in the testing interval 610. However, if desired, packer 604 can be retracted (deflated) thereby allowing the residual cleaning material to disburse downhole if desired. Testing may then begin. Formation fluid may be drawn from interval 610 into the port 652. Note that cleaning fluid 660 was drained during the cleaning period through port 653 and formation fluid 661 is now drawn through port 652 during the testing period. This may be achieved by associating port 652 and 653 with valves (not shown), similar to valves 242 and 243 associated respectively to ports 252 and 253 in FIG. 3.

Turning back to FIG. 6, one or more additional interval may be sealed if needed, including the option of selecting of the length of these additional intervals, as shown by step 570. Also, additional testing may be performed as shown by step 575. At any time, the operator or internal logic may decide to abort the cycle and terminate the test. All the packer elements are preferably retracted (deflated) in step 580 and the testing tool is free to move in the wellbore. Other methods than method 500 may also benefit from sealed interval of adjustable length. These methods include, but are not limited to, injecting materials into the formation, or formation testing to determine for example pressure and mobility of hydrocarbons in a reservoir.

FIGS. 8A-8D show another illustration of a method for testing a subterranean formation according to one aspect of this invention. FIG. 8A-8D show a portion of a testing tool similar to testing tool 10 of FIG. 2, lowered in a wellbore 11 traversing a formation 12, as taught by step 510 of method 500. Testing tool 10 comprises packer elements 702, 703, 704 and 705, and ports 752, 753, 754 and 755. In the example of FIGS. 8A-8D, packer elements 703 is slidable, for example using the apparatus described in more details with respect to FIG. 4.

Figure 8B:
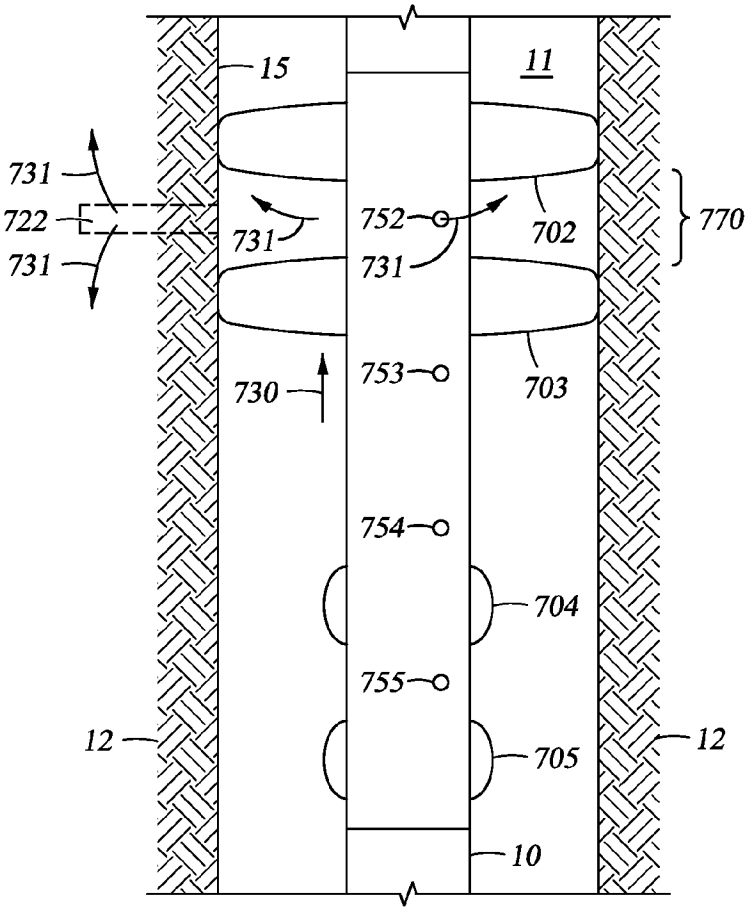
FIGS. 8A-8D are schematics illustrating another a method for testing a subterranean formation.
Figure 8A:
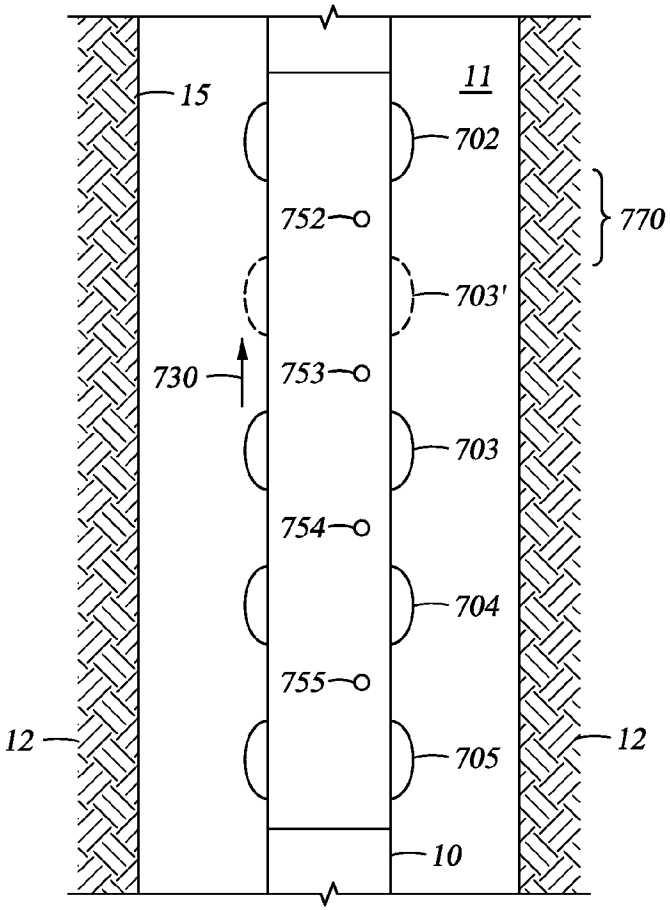

As a way of example, the length of the wellbore interval to be sealed determined in step 515 of method 500 may be represented by interval 770 on FIGS. 8A and 8B. As taught by step 550 of method 500, the testing interval length may then be selected by sliding packer element 703 as indicated by arrow 730 on FIG. 8A. The movement of packer element may be controlled by a downhole controller (not shown), either automatically according to instructions executed by the downhole controller, or under the supervision of a surface operator sending a command to the testing tool. The command sent to the testing tool could comprise a value of the testing interval length determined by the operator, for example in view of information recorded by downhole sensors (not shown) and sent uphole by a telemetry system (not shown).

Figure 1B:
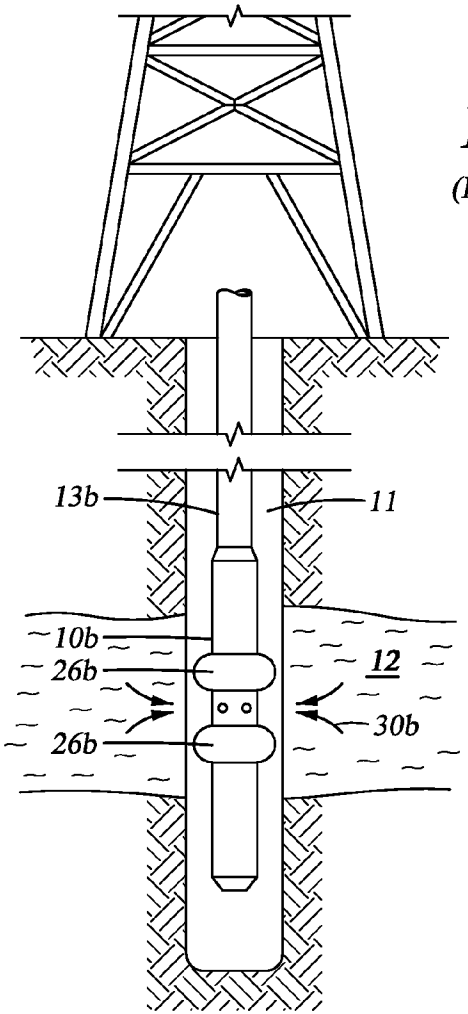
Fig. 1B (PRIOR ART)
FIGS. 1A-1D are elevation views showing typical examples of downhole testing tools, where the testing tool is drill string conveyed in FIG. 1A, tubing string conveyed in FIG. 1B, and wireline conveyed in FIGS. 1C and 1D.
Figure 1A:
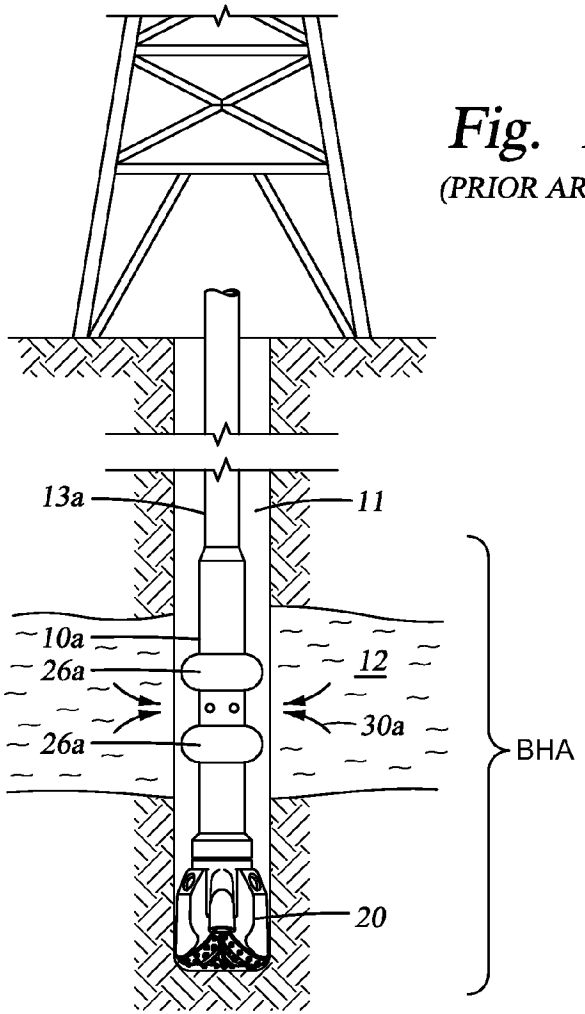
Fig. 1A (PRIOR ART)
Figure 1D:
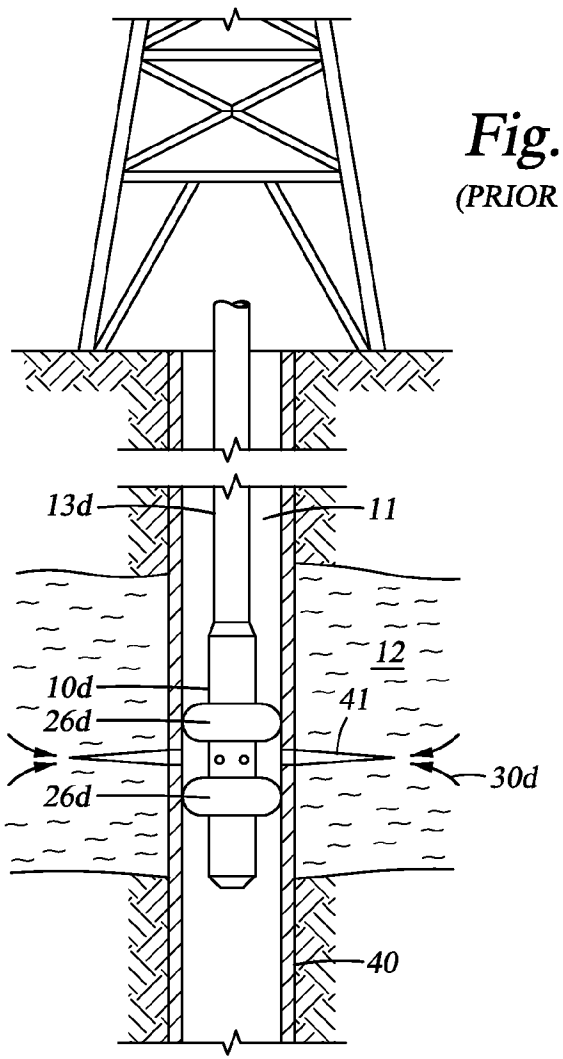
Fig. 1D (PRIOR ART)
Figure 1C:
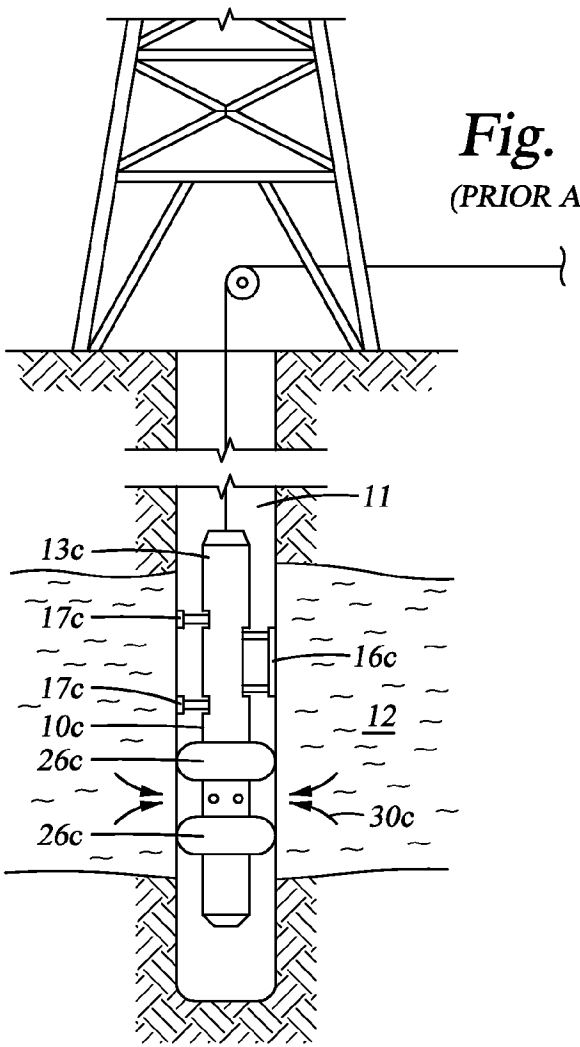
Fig. 1C (PRIOR ART)

FIG. 8B illustrate a first testing operation. In the example of FIG. 8B, packer elements 702 and 703 have been extended into sealing engagement with the wellbore wall 15 (step 555 of method 500) and the testing interval 770 is isolated (step 560 of method 500). The testing operation (step 565 of method 500) may comprise the optional step of perforating the formation as shown by tunnel 722 in formation 12. Perforation may be achieved by perforating guns, such as perforating gun 231 of FIG. 3, or by any other method known by those skilled in the art. Note that the perforation of the formation 12 about the testing interval 770 may be performed before or after inflation of the packer elements 702 and 703. The testing operation shown in the example of FIG. 8B comprises injecting material through the port 752, for example steam, hot water or solvent, into the testing interval 770 and the formation 12. Injection of steam, hot water or solvent may be desirable for example to lower viscosity of heavy hydrocarbon in formation 12 prior to sampling. It may also be desirable for testing the compatibility of the injected fluid with the formation or reservoir fluid. The injected material may be conveyed downhole in a cavity (not shown), similar to cavity 150-1 in FIG. 2, or may also be conveyed from the surface into the conveyance mean 13*b*, as explained above with respect to FIG. 1B. The testing operation preferably allows for the injected material to diffuse in the formation 12, as indicated by arrows 731. During this soaking period, various sensors (not shown) may measure formation of fluid properties, such as fluid temperature, fluid pressure, or formation resistivity profile along the radial, axial or azimuthal direction of the wellbore.

Figure 8D:
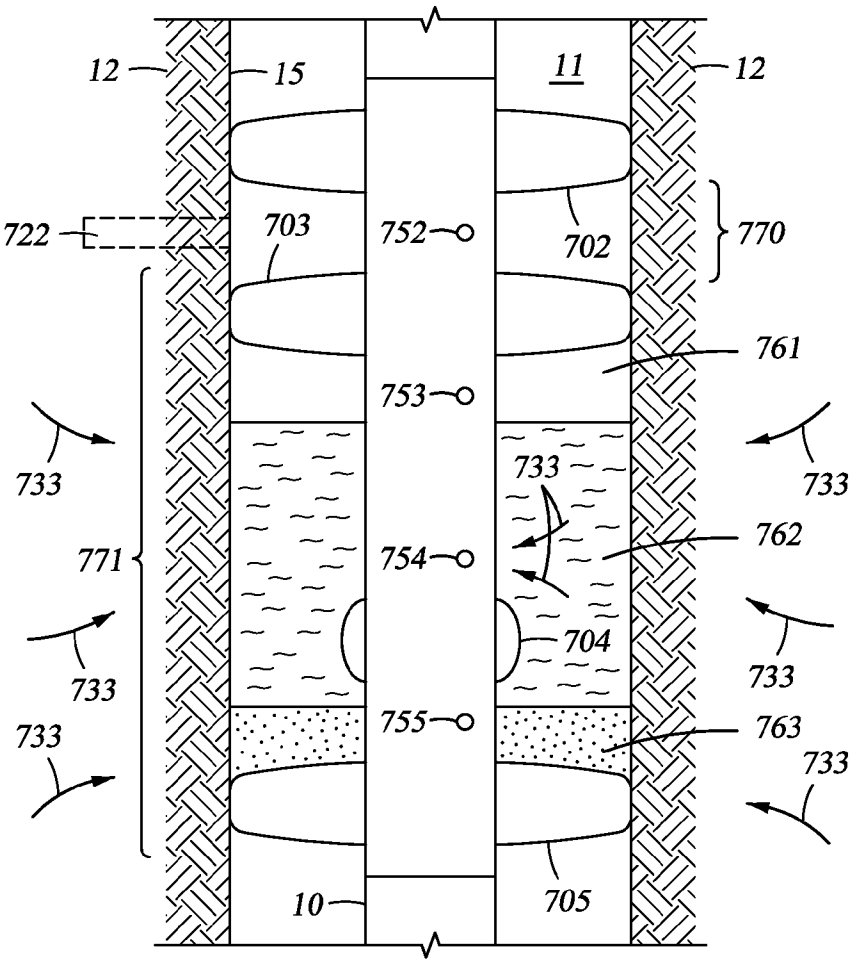
Figure 8C:
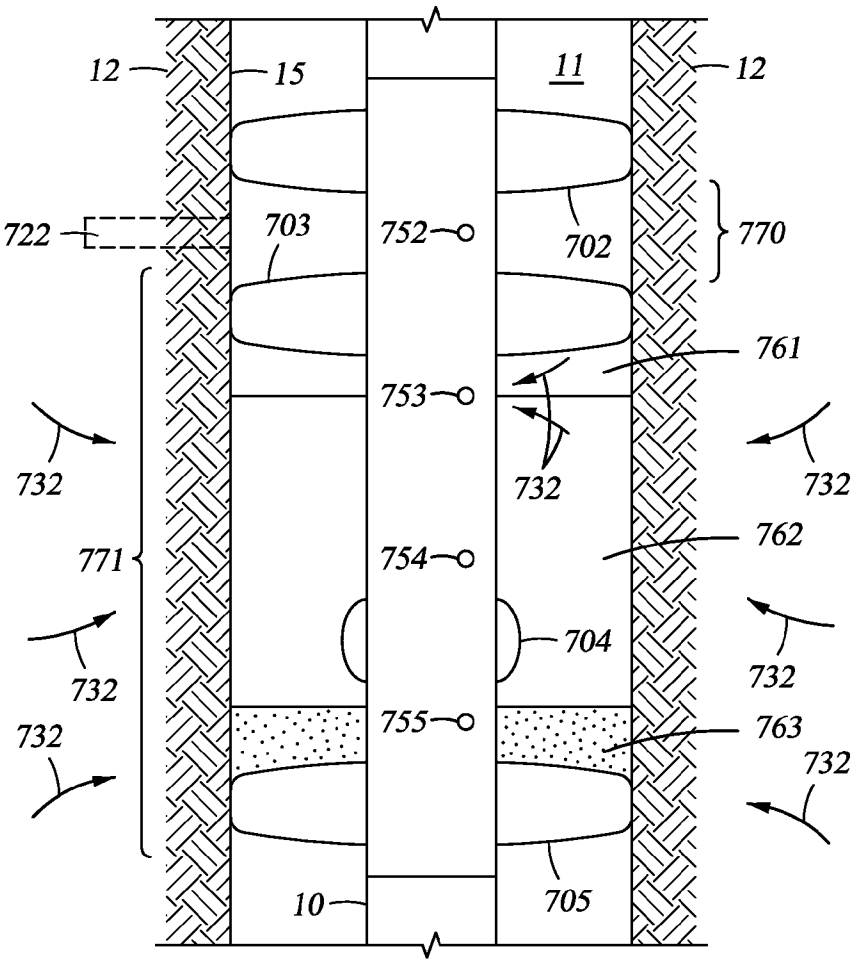

FIGS. 8C and 8D illustrate an optional testing operation following the injection described in FIG. 8B. The length of a second testing interval can be selected, for example from the set of the distance between packer element 703 and 704, the distance between packer 703 and 705 or the distance between packer 704 and 705. In the example of FIG. 8C, a second testing interval 771 between packer elements 705 and 703 is sealed, as taught by step 570 of method 500. Alternatively, packer element 704 may have been enabled instead of packer element 705, sealing thereby a second testing interval with a shorter length. The testing tool may start drawing fluid from interval 771 through port 753, as taught in step 575 of method 500. Fluid leaving the interval 771 may be replaced by sand 763, produced by an unconsolidated formation, and formation fluid 762, as indicated by arrows 732. Note that in the example of FIG. 8C, it is assumed that the density of the formation fluid 762, for example heavy oil, is larger than the density of the wellbore fluid 761, for example water. Note also that formation fluid 762 may be contaminated by injection materials or other materials.

FIG. 8D shows the continuation of the sampling process started in FIG. 8C. In FIG. 8D, an alternate fluid communication with the testing tool is established through port 754 by selectively opening a valve (not shown) associated with port 754, for example a valve similar to valve 243*b* of FIG. 3, and by closing a valve (not shown) associated with port 753, for example a valve similar to valve 243*a* of FIG. 3. This operation may be initiated by a surface operator, for example in view of fluid properties measured by the testing tool, for example by a sensor similar to sensor 131 of FIG. 2, and send uphole via telemetry. This operation may alternatively be initiated by a downhole controller. Thus, formation fluid 762 may enter the testing tool through port 754, as indicated by arrows 733. In the example of FIG. 8D, packer element 704 has not been inflated, increasing thereby the risk of particles, such as sand or other debris, to enter the testing tool via port 754. In some cases, there may still be particles in suspension in formation fluid 754. It may be advantageous to pulverize these particles with particle breaking devices, such as particles breaking devices 160, 161 or 162 on FIG. 2. Formation fluid may then be analyzed by one or more sensor in the testing tool and/or captured in a cavity in the testing tool and brought to the surface for further analysis, as known by those skilled in the art.

In the example of FIG. 8C, the second testing interval 771 is located below the first interval, for example to take advantage of gravity during a sampling operation of a heavy hydrocarbon in formation 12. It will be appreciated by those skilled in the art that a second testing interval may have alternatively be chosen above the first interval, for example by extending initially packer elements 704 and 705 for sealing the first testing interval. Alternatively, the second testing interval may comprise the first testing interval, for example by extending packer element 704 and retracting packer element 703.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for testing a subterranean formation penetrated by a wellbore, comprising:

positioning a testing tool in the wellbore, the testing tool comprising a tool body, a sensor, a plurality of packer elements spaced apart from one another along the longitudinal axis of the tool body, and a port on the tool body located between two of the plurality of packer elements;

extending at least two packer elements into sealing engagement with the wellbore wall;

sealing a first interval of the wellbore;

flowing fluid between the first sealed interval and the testing tool through the port;

monitoring a property with the sensor;

extending a third packer element into sealing engagement with the wellbore wall, wherein extending the third packer element into sealing engagement with the wellbore wall is triggered by the monitored property; and sealing a second interval of the wellbore.

2. The method of claim 1 further comprising flowing fluid from the second sealed interval into the testing tool through the port.

3. The method of claim 1 wherein the first interval comprises the second interval.

4. The method of claim 1 wherein the testing tool comprises a second port and the method further comprises flowing fluid from the second sealed interval into the testing tool through the second port.

5. The method of claim 1 wherein the testing tool comprises a cavity in fluid communication with the port, the cavity carries a material, and flowing fluid between the first sealed interval and the testing tool through the port comprises releasing the material in the wellbore.

6. The method of claim 1 wherein the testing tool comprises a cavity in fluid communication with the port, and wherein flowing fluid between the first sealed interval and the testing tool through the port comprises drawing fluid into the cavity.

7. The method of claim 1 further comprising pulverizing particles carried by the fluid flowed through the port.

* * * * *